US006906607B1

(12) United States Patent
Weber et al.

(10) Patent No.: US 6,906,607 B1
(45) Date of Patent: Jun. 14, 2005

(54) METHOD FOR PRODUCING AND MAGAZINING INDIVIDUAL MAGNETIC COMPONENTS AND THE ASSEMBLY THEREOF FOR PRODUCING MINIATURIZED MAGNETIC SYSTEMS AND SUCH MAGNETIC SYSTEMS

(75) Inventors: Lutz Weber, Contwig (DE); Matthias Nienhaus, Mainz (DE); Stephan Kleen, Mainz (DE); Wolfgang Ehrfeld, Mainz (DE)

(73) Assignee: Institut Fur Mikrotechnik Mainz GmbH (DE)

( * ) Notice: Subject to any disclaimer, the term of this patent is extended or adjusted under 35 U.S.C. 154(b) by 50 days.

(21) Appl. No.: 10/129,682

(22) PCT Filed: Nov. 8, 2000

(86) PCT No.: PCT/EP00/11024

§ 371 (c)(1),
(2), (4) Date: Aug. 21, 2002

(87) PCT Pub. No.: WO01/35427

PCT Pub. Date: May 17, 2001

(30) Foreign Application Priority Data

Nov. 8, 1999 (DE) ..... 199 53 650

(51) Int. Cl.[7] ..... H01F 7/02
(52) U.S. Cl. ..... 335/303; 335/306
(58) Field of Search ..... 335/284, 285, 335/306; 600/9, 15; 5/693

(56) References Cited

U.S. PATENT DOCUMENTS

| | | | | |
|---|---|---|---|---|
| 3,615,993 A | * | 10/1971 | French | 156/155 |
| 4,033,054 A | * | 7/1977 | Fukuoka | 36/11.5 |
| 4,998,084 A | | 3/1991 | Alff | |
| 5,536,401 A | * | 7/1996 | Burns | 210/222 |

FOREIGN PATENT DOCUMENTS

| | | |
|---|---|---|
| DE | 44 23 700 | 12/1994 |
| DE | 195 33 120 | 3/1997 |
| DE | 196 22 262 | 12/1997 |
| DE | 199 02 370 | 8/2000 |
| DE | 199 02 371 | 8/2000 |
| EP | 213 732 | 3/1987 |
| WO | WO 93/22778 | 11/1993 |

OTHER PUBLICATIONS

Design and Realization of a Penny–Shaped Micromotor in Proc. SPIE vol. 3680–65, Part Two, Parts of the Symposium on Design, Test, and Microfabrication of MEMS and MOEMS, Paris, France, Mar.–Apr. 1999, 592–600ff.

(Continued)

*Primary Examiner*—Ramon M. Barrera
(74) *Attorney, Agent, or Firm*—Hudak Shunk & Farine Co.

(57) ABSTRACT

The object of the invention is to produce multipole magnetic systems that are composed of a plurality of individual magnetic components that preferably are made of rare-earth magnetic material. The invention relates to a method for producing and magazining at least one individual magnetic component, a magazine for at least one individual magnetic component by molding and for conventionally magnetizing the same. The invention further relates to a method of assembly for producing a magnetic system and to the resulting magnetic systems. The invention teaches that extremely flat multipole magnetic systems in the form of magnet rings or magnet strips and three-dimensional magnet bodies such as a magnetic scale, for example, can be produced by means of individual magnetic components that are directly adjacent to each other or are arranged at a distance by means of a molding material, for example. The magnetic systems taught by the invention are provided with a particularly high level of integration of the individual magnetic components and a uniform overall magnetization of the magnet segments which, acting as permanent magnet components, can be used in electromagnetic drives, magnetic path and angle measuring systems, magnetic couplings and valves, for example.

16 Claims, 22 Drawing Sheets

OTHER PUBLICATIONS

Winziger Encoder fur Elektromotoran, F&M 106 (1998) 4, p. 194 ff, published by Carl Hanser Verlag.

Kleine Kraftpakete–Strukturierte dunne Magnetschichten (Small Power Packets–Structurable thin magnetic films), F&M 107 (1999) 4, p. 24ff., published by Carl Hanser Verlag.

Optimierte magnete fur Hybridschrittmotoren (Optimized Magnets For Hybrid Stepper Motors), F&M 106 (1998) 7–8, p. 503ff, published by Carl Hanser Verlag.

* cited by examiner

Fig. 1a
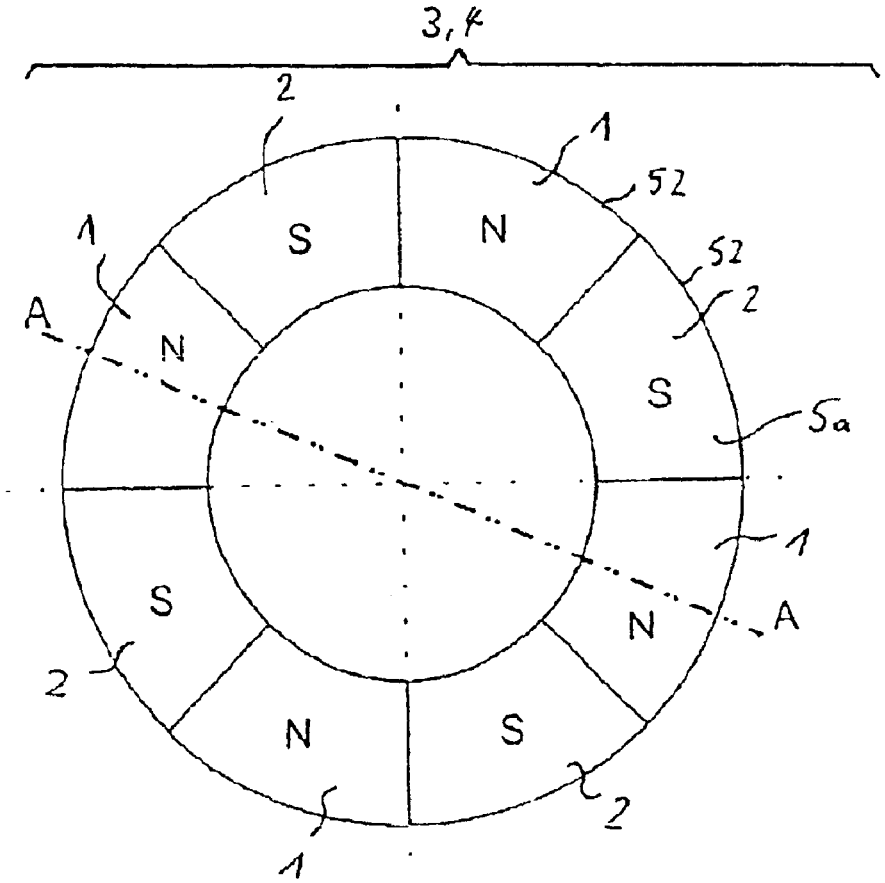
Fig 1b
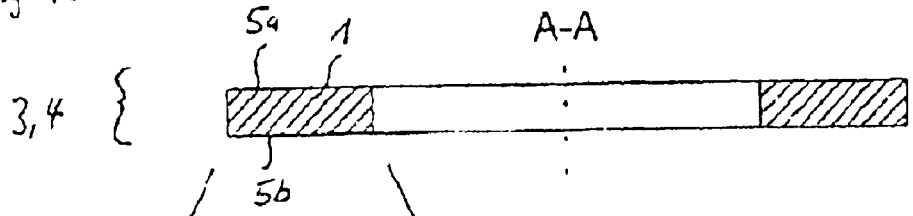
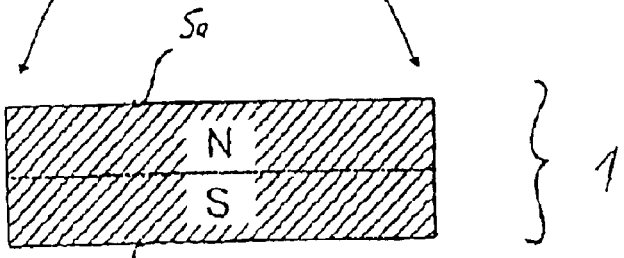
Fig. 1c

Fig. 2a
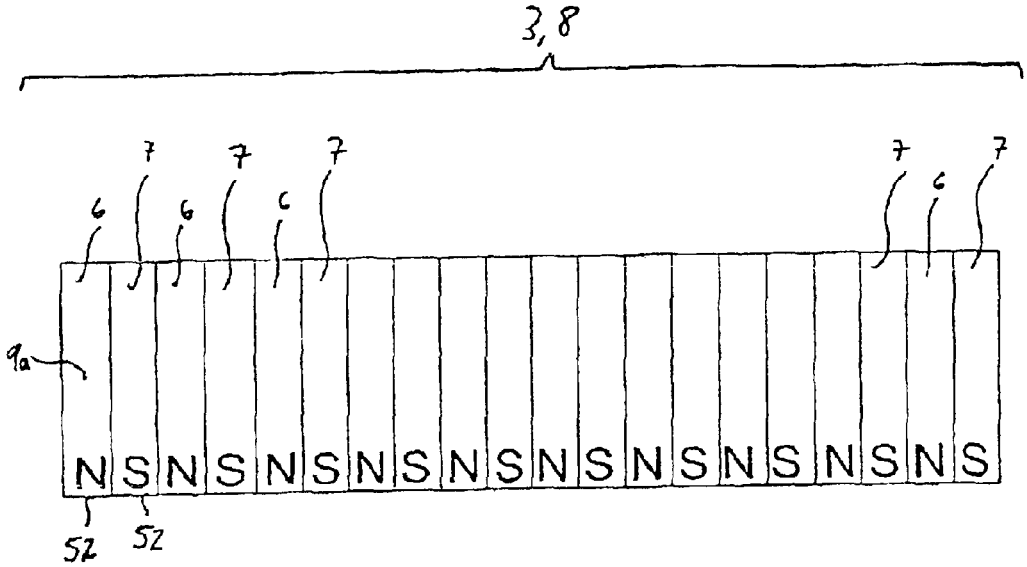
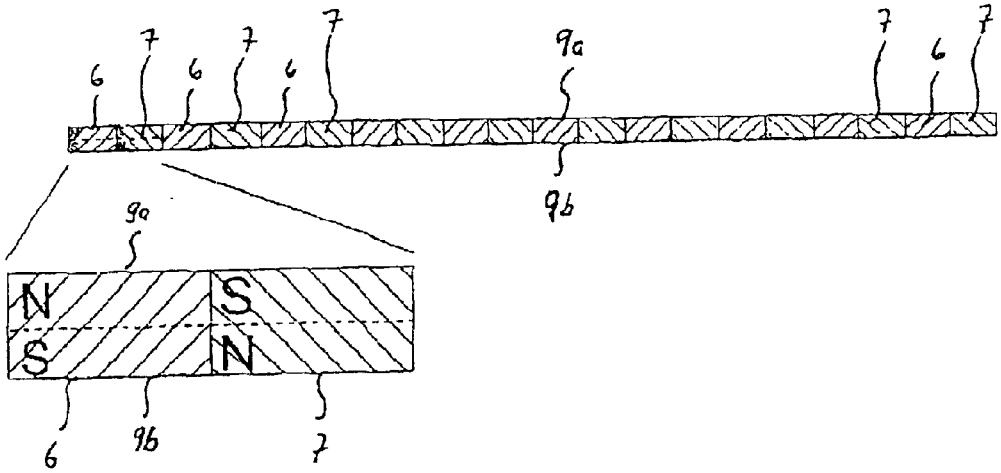
Fig. 2b

Fig. 4a
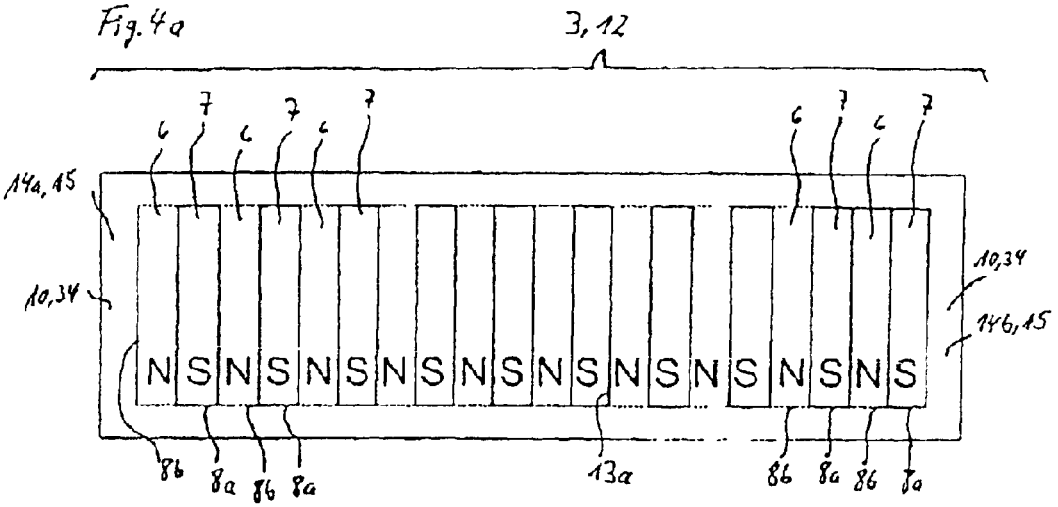
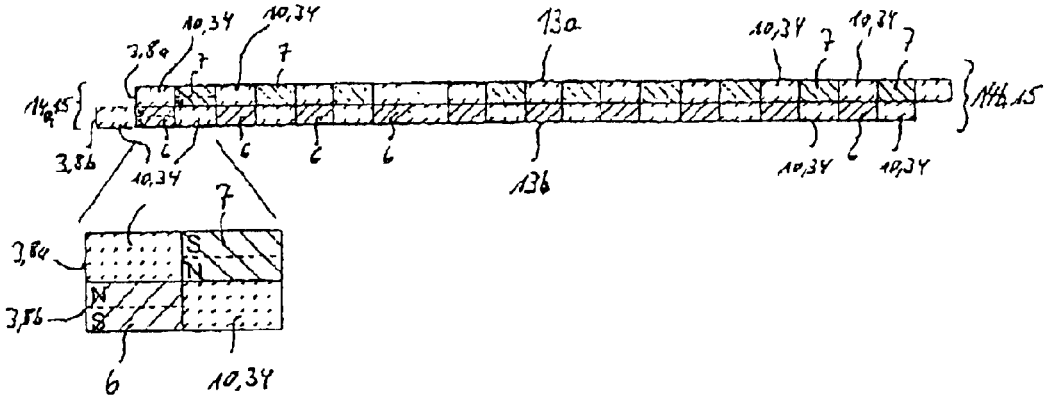
Fig. 4b

Fig. 9a
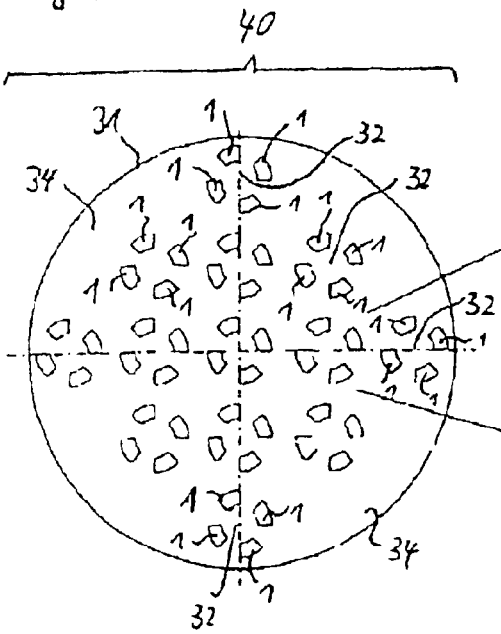
Fig. 9b
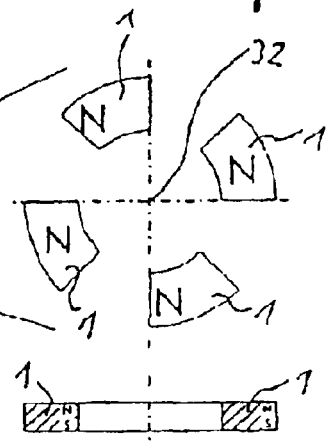
Fig. 9c
Fig. 10a
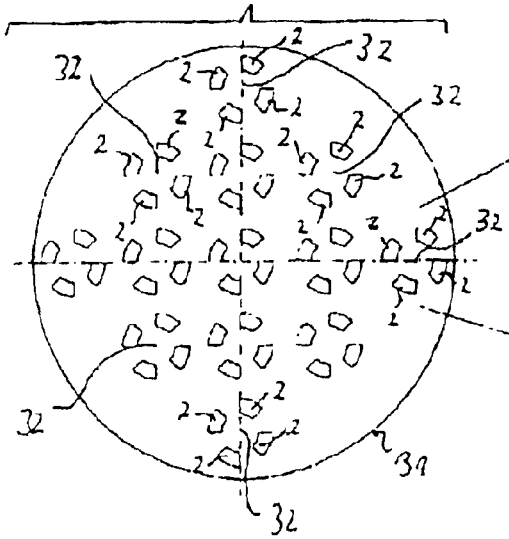
Fig. 10b
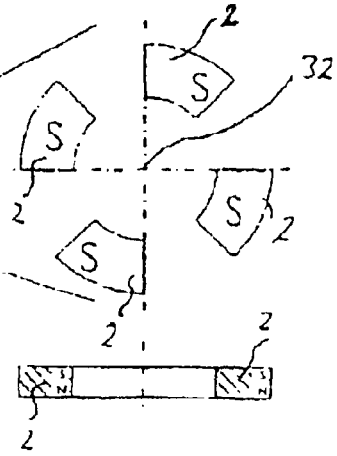
Fig. 10c Fig. 11a
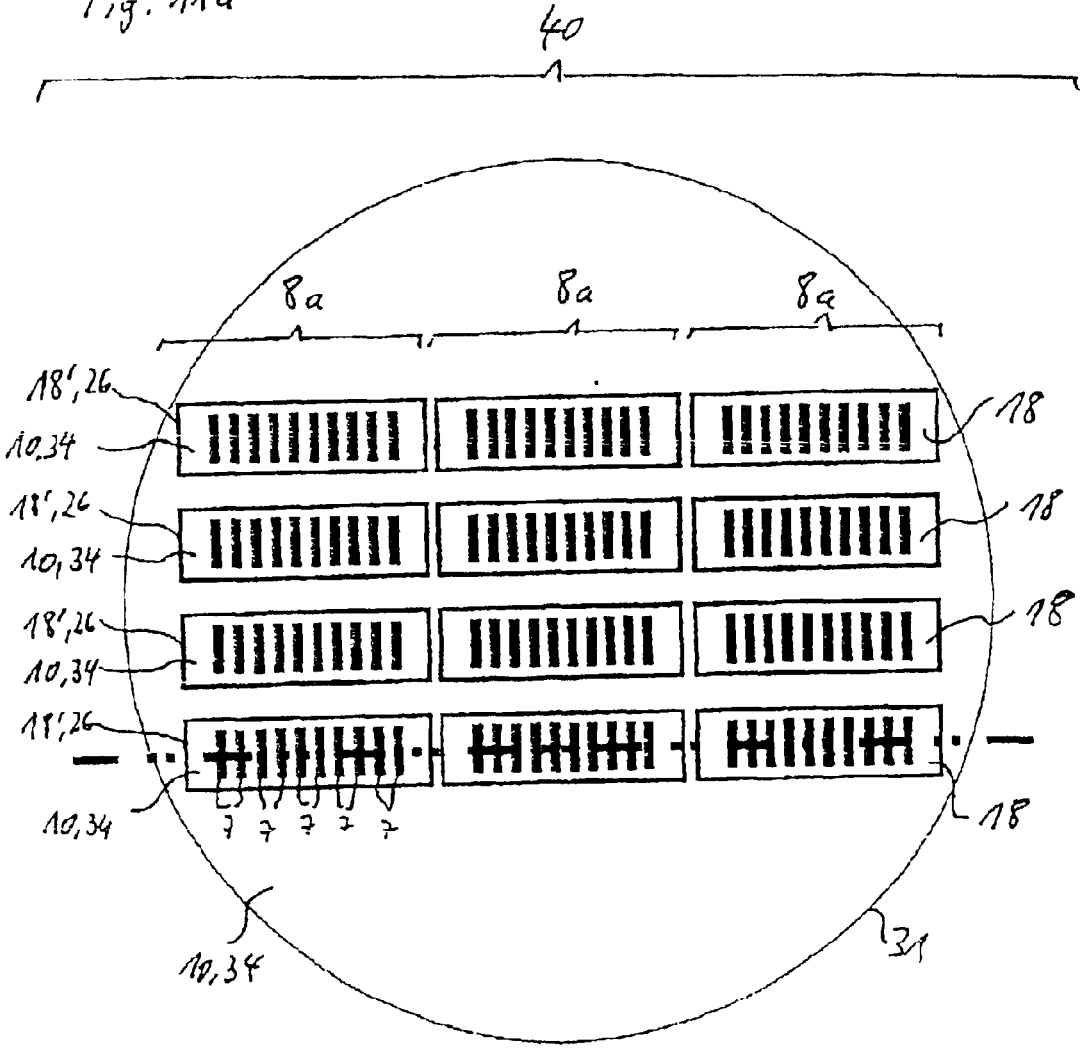
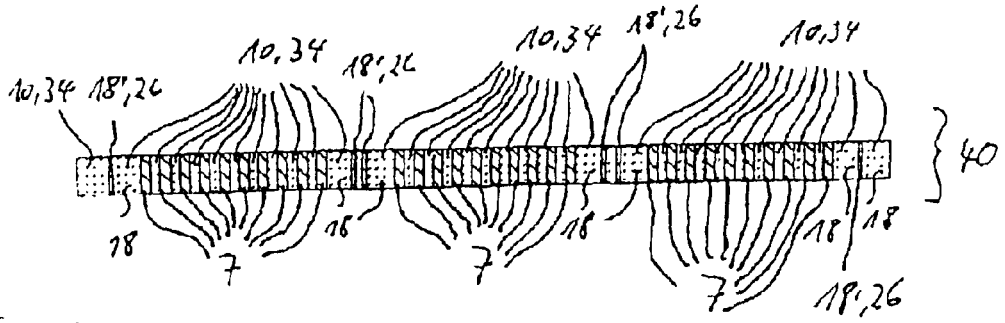
Fig. 11b

50

Fig. 21a
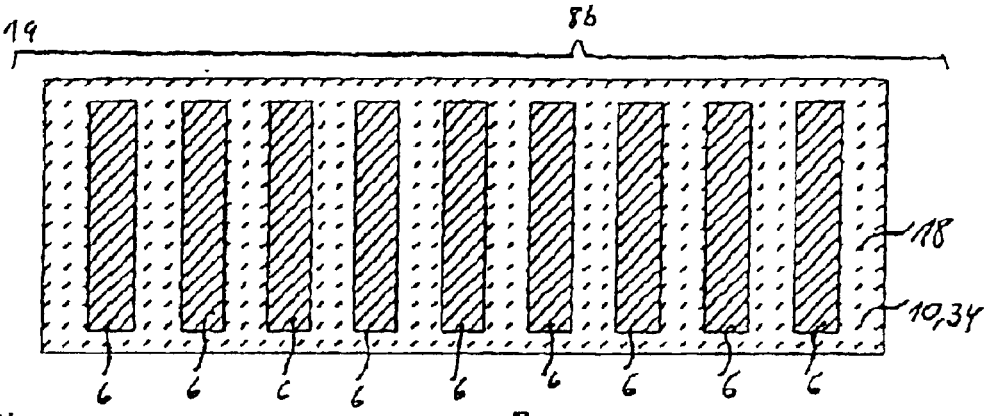
Fig. 21b
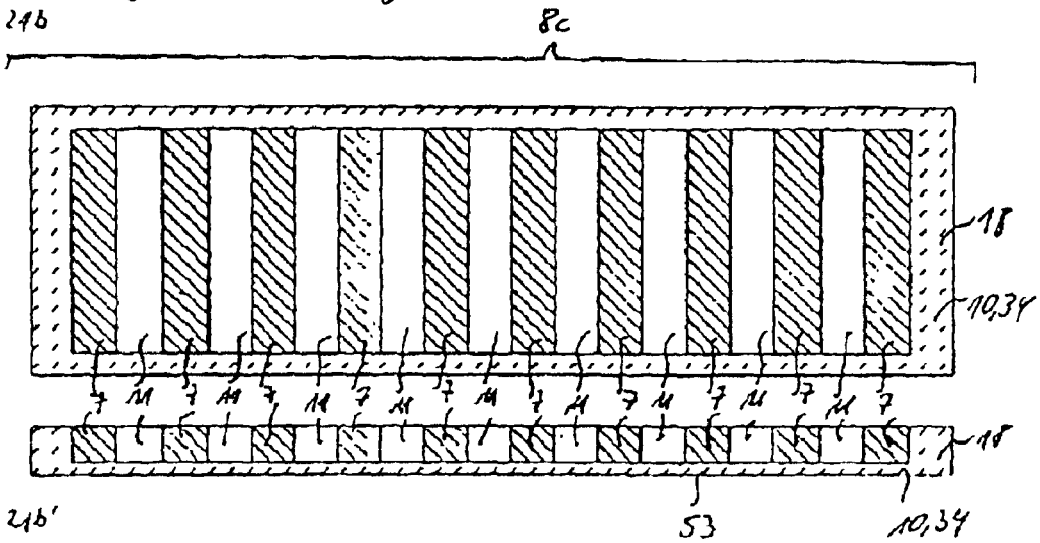
Fig. 21b'
Fig 21c
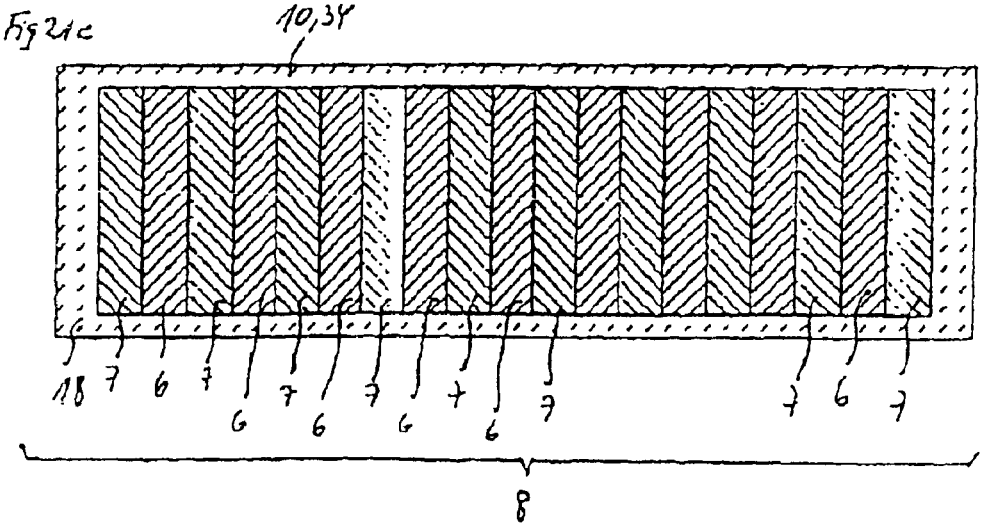

METHOD FOR PRODUCING AND MAGAZINING INDIVIDUAL MAGNETIC COMPONENTS AND THE ASSEMBLY THEREOF FOR PRODUCING MINIATURIZED MAGNETIC SYSTEMS AND SUCH MAGNETIC SYSTEMS

FIELD OF THE INVENTION

This invention relates to the manufacture of multipole magnetic systems that are comprised of a plurality of individual magnetic components. For this purpose, a method is indicated for the manufacture by molding and magazining of at least one individual magnetic component, a magazine for at least one individual magnetic component and its magnetization, an assembly method for the manufacture of a magnetic system and the resulting magnetic systems, such as, for example, a magnet ring, a magnet strip and a magnetic scale.

BACKGROUND OF THE INVENTION

Magnetic systems of the type described above are used, for example, in electromagnetic drives, such as permanent and hybrid drives, in magnetic distance and angle measurement systems, in magnetic couplings and valves and in magneto-sensitive sensors. In the course of miniaturization, these systems must be made smaller and smaller while achieving similar performance, or they must retain the same size while achieving ever-increasing performance. On one hand, magnetic systems are required that can be adapted visually to the measurement systems or the functional geometry of these systems. These systems can be both flat, two-dimensional magnetic films as well as magnet systems with a complex three-dimensional external shape. On the other hand, high-output magnetic materials such as rare-earth magnetic materials, in particular NdFeB, are being used. The advantage of NdFeB magnetic systems is that even at low magnetic film thicknesses, a high magnetic actuation and high B-field can be achieved in the magnetic circuit. NdFeB has a high magnetic hardness and a low demagnetization. Furthermore, a uniform overall magnetization of the magnet segments is desirable, to achieve the sharpest possible transition between two neighboring, oppositely polarized magnetic segments.

A disadvantage with the use of NdFeB magnetic systems is that magnetic field strengths of up to more than 500 kA/m and correspondingly high magnetization currents must be used for the production of the magnetic segments. In conventional magnetization devices, the magnetization of these magnetic systems is realized in a process by means of pulse magnetization with a short heavy current pulse by a magnetizer coil that is specially adapted to the magnetic system A disadvantage of this method is that on account of the extremely high magnetization currents, correspondingly large line cross sections are necessary for the coils, and that is a limiting factor for the distance between pole centers and thus for the integration density of the magnets. By means of this method, it becomes possible to manufacture magnetic systems with strip-shaped, multipole magnetization and distances between pole centers of 2 or 1 mm.

For example, as described in the publication "Micromachining and Microfabrication" in Proc. SPIE Vol. 3680B-65, for the manufacture of the disc rotor motor and its rotor disc described in the two German patent applications DE 199 02 370 and DE 199 02 371, a magnetic ring was manufactured by molding from NdFeB magnetic material. This ring was then multipole magnetized completely in a conventional pulse magnetization device with a coil shaped to correspond to the magnetic segments to be formed. On one hand, magnetic field losses are found in the peripheral areas between two magnetic segments, and on the other hand, the configuration of the magnetic surface is already significantly restricted by the fact that almost no magnetization takes place in areas of the coil windings.

With conventional shapes of the magnetization coils, moreover, complicated shapes of magnetic systems cannot be magnetized in a single process. As an alternative, the magnetic segments are produced individually, whereby magnetization heads generate part of the required magnetic field strength. A disadvantage of this method is that it is a serial process, and therefore requires a good deal of time to complete. Furthermore, to achieve the necessary saturation, a minimum distance must be maintained between the magnetic head and the surface to be magnetized, which is a limiting factor in the reduction of the distance between pole centers. Moreover, the very high forces that occur during the magnetization process place mechanical loads on the magnetization heads, which means that the magnetization heads must be provided with complex retaining and support structures.

To eliminate the problems of the magnetization of miniaturized magnetic systems described above, DE 195 33 120 A1 and the corresponding publication in the journal "Feinwerktechnik und Mikrotechnik, Mikroelektronik (FuM)" 105 (1998) 4, p. 194 ff., Carl Hanser Verlag, for the formation of a magnetic position sensor, describe a magnetic disc or a code carrier and a method for its manufacture, whereby the code carrier consists of two parts with a tooth structure on the periphery. The two parts are radially magnetized separately from each other, one part with the magnetic north pole on the outside periphery and the other part with the south pole on the outside periphery. When the two parts are put together, the desired alternating magnetic field is formed. One disadvantage with this process is that to assemble the code carrier, molded joint structures are required, which in this case are in the form of tooth structures. These joint structures also limit the further miniaturization of the code carriers.

SUMMARY OF THE INVENTION

The object of the invention is therefore to significantly improve a multipole magnetic system consisting of a plurality of individual magnetic components and a method for the manufacture of these individual magnetic components, as well as a method for the assembly of the individual magnetic components into such a magnetic system, so that any desired distance between pole centers can be created accurately and reproducibly, whereby a conventional magnetization device can be used, and magnetic systems can be manufactured with directly adjacent individual magnetic components. An additional object of the invention is to manufacture magnetic systems with retaining or joint structures that do not increase the height and size of the magnetic systems.

The invention teaches that the magnetic system to be fabricated is manufactured from a plurality of individual magnetic components, whereby a method taught by the invention is used for the manufacture by molding and magazining of at least one and preferably a plurality of individual magnetic components, and the entire magazine with the individual magnetic components is magnetized all at once in a magnetization device. The magazine is described by the characteristic features disclosed herein. Then the magnetized individual magnetic components are assembled directly from the magazine into a multipole magnetic system with two assembly methods taught by the invention. The magnetic systems preferably formed by these methods are also described herein below.

Additional objectives, advantages, features and possible applications of the Invention are explained in the following detailed description of a number of different exemplary embodiments, with reference to the accompanying drawings. All the features described and/or illustrated in the figures, individually or in any reasonable and desired combination, are the object of the invention, regardless of their placement in the claims or the reference numbers applied to them.

BRIEF DESCRIPTION OF THE DRAWINGS

In the figures:

FIG. 1 a) is a plan view from overhead, and b) is a section through a magnet ring composed of a plurality of individual magnetic components.

FIG. 2 a) is a plan view from overhead, and b) is a section through a magnet strip composed of a plurality of individual magnetic components.

FIG. 4 a) is a plan view from overhead and b) is a section through a magnetic scale composed of two magnet strips as illustrated in FIG. 3.

FIG. 9 a) is a plan view from overhead and b) is a detail and c) a section through the detail of a magazine with individual magnetic components in the shape of segments of a circular ring magnetized radially in the north-south pole direction.

FIG. 10 a) is a plan view from overhead and b) is a detail and c) a section through the detail of a magazine with individual magnetic components in the shape of segments of a circular ring magnetized radially in the south-north pole direction.

FIG. 11 a) is a plan view from overhead and b) is a section through a magazine with rectangular solid individual magnetic components magnetized axially in the south-north pole direction.

FIG. 21 illustrates the assembly of a magnet strip as illustrated in FIG. 2 with one magazine as illustrated in FIG. 11 and one magazine as illustrated in FIG. 13.

DETAILED DESCRIPTION OF THE INVENTION

Figure 3:
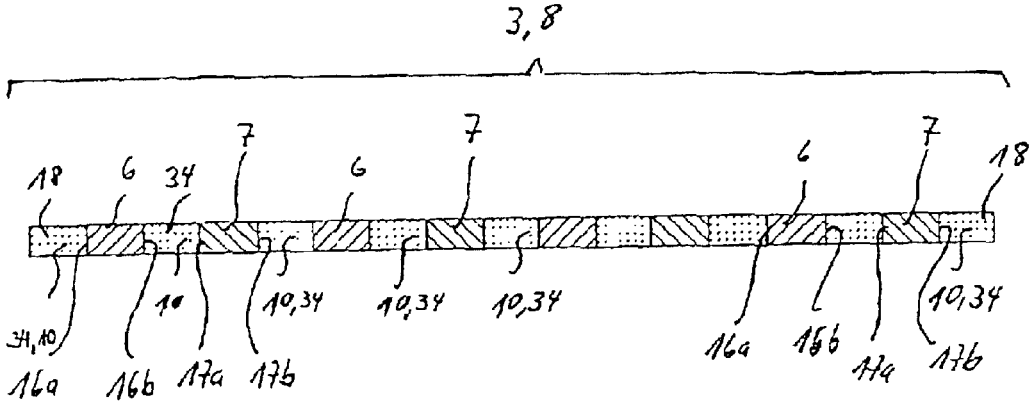
FIG. 3 shows an additional embodiment of the magnet strip.

FIG. 1*a* shows a plan view from overhead and FIG. 1*b* shows a section through a multipole magnet system 3 in the form of a magnet ring 4 assembled from a plurality of magnetized individual magnetic components 1, 2.

The individual magnetic components 1, 2 in the exemplary embodiment selected here, which can be accurately and reproducibly manufactured using an injection compression method, are both made of a magnetizable and moldable permanent magnetic material, such as plastic-bonded NdFeB material, for example. The use of plastic-bonded NdFeB material makes possible the molding of thin-walled or flat shapes of the individual magnetic components 1, 2. The individual magnetic components 1, 2 have the external shape 52 of the segments of a circular ring, and as illustrated in FIG. 1 are arranged in the magnet ring 4 alternately and directly adjacent to each other. The thickness of the magnet ring 4 is approximately 300 $\mu$m. It would also be possible to use other manufacturing molding methods, such as injection molding or compression molding, for example. Moldable SmCo, such as plastic-bonded SmCo, for example, can also be used as the magnetic material. The individual magnetic components 1, 2 can also be made of magnetic materials with a low remanent induction, such as hard ferrites on a strontium or barium basis, for example, or a magnetizable material with a low coercive field strength such as AlNiCo, for example.

Figure 8A:
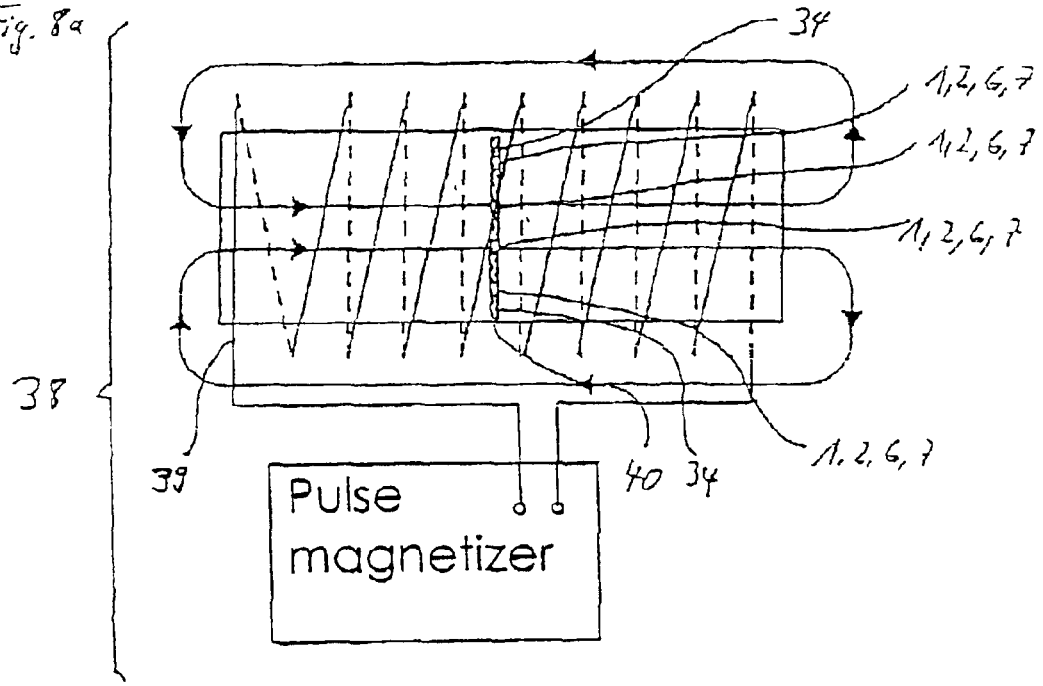
FIG. 8 a) shows the axial and b) the diametrical simultaneous magnetization of the individual magnetic components placed in the magazine as illustrated in FIG. 7.

The invention teaches that the individual magnetic components 1, 2 are magnetized in a conventional magnetization device as illustrated in FIG. 8 by means of pulse magnetization along their longitudinal and transverse dimension. The individual magnetic components 1, 2 are both axially magnetized, and in particular so that the individual magnetic components 1 are magnetized in the north-south pole direction, which is another way of saying that the individual magnetic components 1 illustrated in FIG. 1*c* have a north pole on the one end surface 5*a* and a south pole on the other end surface 5*b*. The individual magnetic components 2 are correspondingly polarized axially in the opposite south-north pole direction, i.e. they have a south pole on the end surface 5*a* and a north pole on the end surface 5*b*. Consequently, the magnet ring 4 assembled from the individual magnetic components 1, 2 is an 8-pole assembly on both end surfaces 5*a*, 5*b* and therefore has 4 pairs of poles.

The magnet ring 4 is used as the rotor disc in a DC disc rotor motor as described in one of the two patent applications DE 199 02 370 and DE 199 02 371. As a result of the extremely flat vertical dimension of the magnet ring 4, the disc rotor motor has a vertical dimension of only 1.4 mm with an outside diameter of 12.8 mm. The torque constant of the motor is approximately 0.40 $\mu$Nm/mA. The motor can be used without further modification for speeds of rotation of up to 20,000 $min^{-1}$ with very high freedom from vibration.

In general, the molding manufacture of the individual magnetic components taught by the invention and their separate magnetization can be used to accurately and reproducibly manufacture any desired distance between pole centers. In addition, the magnet ring 4 has no large support or retaining structures. This arrangement makes possible the further miniaturization of systems in which the magnet ring 4 is used, such as, for example, electromagnetic drives, including hybrid stepper motors and disc rotor motors. In this regard, reference is made to the article entitled "Kleine Kraftpakete—Strukturierte dünne Magnetschichten" [Small Power Packets—Structurable thin magnetic films] in the journal F&M 107 (1999) 4, p. 24 ff, and to the article entitled "Optimierte Magnete für Hybridschrittmotoren" [Optimized magnets for hybrid stepper motors] in F&M 106 (1998) 7–8 p. 503 ff., both published by Carl Hanser Verlag.

FIG. 2*a* shows a plan view from overhead and FIG. 2*b* shows a section through a multipole magnet system 3 in the form of a magnet strip 8 made up of a polarity of magnetized individual magnetic components 6, 7. The Individual magnetic components 6, 7 have a rectangular solid outer shape 52 and are arranged alternately and directly adjacent to one another in the magnet strip 8. The thickness of the magnet strip 8 is approximately 300 $\mu$m. The individual magnetic components 6, 7 are both axially magnetized, whereby the individual magnetic components 6 have a north pole on the end surface 9*a* of the magnet strip 8 illustrated in FIG. 2 and the individual magnetic components 7 have a south pole. Consequently, the magnet strip is polarized on the end surface 9*a* as well as on the end surface 9*b* with 19 poles with north and south poles in alternation. This magnet strip 8 formed from permanent magnets of alternating polarity can be used as a permanent magnet component in magnetic distance measurement systems, for example, in an embodiment designed to take measurements of length.

FIG. 3 is a section through an additional exemplary embodiment of the magnet strip 8 formed from permanent magnets of alternating polarity. In contrast to the embodiment illustrated in FIG. 2, the individual magnetic components 6, 7 are located next to one another by a carrier 10. The carrier 10 is made of a molded material 34 and in the exemplary embodiment illustrated here is made of a two-component molding resin. Another preferred carrier material is a thermoplastic or elastomer plastic. As illustrated in FIG. 3, the carrier 10 or the molded material 34 encompasses the individual magnetic components 6, 7 on their lateral surfaces 16*a, b* and 17*a, b* in a positive or form-fitting manner, and molding material 34 is located between each two neighboring individual magnetic components 6, 7. In this embodiment, the individual magnetic components 6, 7 are kept separate from one another by the carrier material, so that magnet systems 3 with a greater distance between pole centers can be manufactured. The carrier material arranged in this manner also performs a supporting and retaining function between each two individual magnetic components 6, 7 and thereby improves the mechanical stability of the magnet strip 8, although without increasing its height. The necessary mechanical stability of this magnet strip 8 is further improved by the fact that the carrier 10 is also realized so that it acts as a form-fitting outer enclosure 18 for the individual magnetic components 6, 7. The external shape of the enclosure 18 can therefore be a circle, a strip or a similar shape.

FIG. 4*a* is a plan view from overhead and FIG. 4*b* is a section through a magnetic scale 12 that is put together from two magnet strips 8*a, b*. The magnet strip 8*a* illustrated in FIG. 4*b*, in contrast to the magnet strip 8 illustrated in FIG. 3, has individual magnetic components 7 that are magnetized only in the south-north pole direction, and are located at some distance from one other by the carrier 10 made of molding material 34. In the same manner, individual magnetic components 6 magnetized in the north-south pole direction are assembled into the magnet strip 8*b*. The magnetic scale 12 illustrated in FIG. 4*b* consists of the two magnet strips 8*a* and 8*b* located one on top of the other, whereby the individual magnetic components 7 can be arranged so that they are laterally offset with respect to the individual magnetic components 6, so that the magnetic scale 12 has alternating polarity on the two end surfaces 13*a, b*. In the exemplary embodiment illustrated here, the magnetic scale 12 illustrated in FIG. 4*a* in an overhead plan view has south poles of the individual magnetic components located next to each other in the magnet strip 8*a* of the end surface 13*a*, and between them, as shown in the sectional view, north poles of the individual magnetic components 6 located in the magnet strip 8*b*. As a result of this arrangement of the individual magnetic components 6, 7, the magnetic scale 12 generates an alternating magnetic flux along the end surface 13*a*. Thus the magnetic scale 12 can be coupled in a rotationally symmetrical shape to a motor shaft and act as a decoder. On the other hand, the magnetic scale 12 can also be used in a linear actuator to embody the longitudinal dimension, and thus provide a length measurement. In the exemplary embodiment illustrated in FIGS. 4*a* and 4*b*, the two ends 14*a*, 14*b* of the magnetic scale 12 can be realized in the form of non-magnetizable carrier material in the form of a step 15. These steps 15 make possible a lateral gripping of the magnetic scale 12, without having to come into contact with the individual magnetic components 6, 7. Of course, the two ends 14*a, b* of the magnetic scale 12 can also be realized in the form of perpendicular ends without a step 15.

Figure 5A:
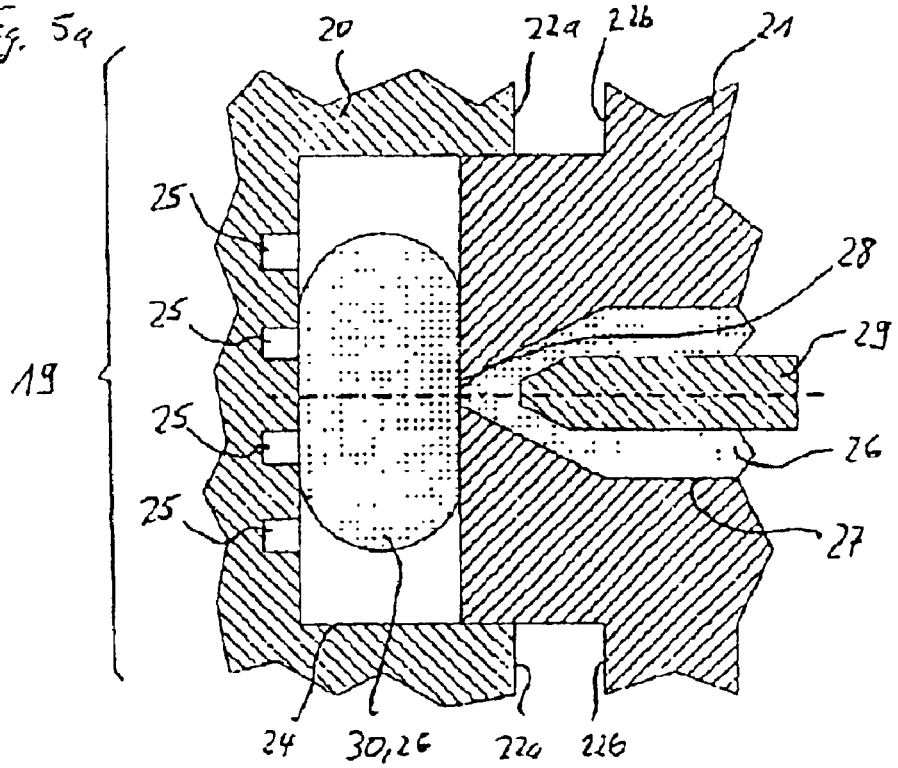
FIGS. 5*a–d* illustrate the manufacture by molding of the individual magnetic components illustrated in FIGS. 1 to 4.
Figure 5B:
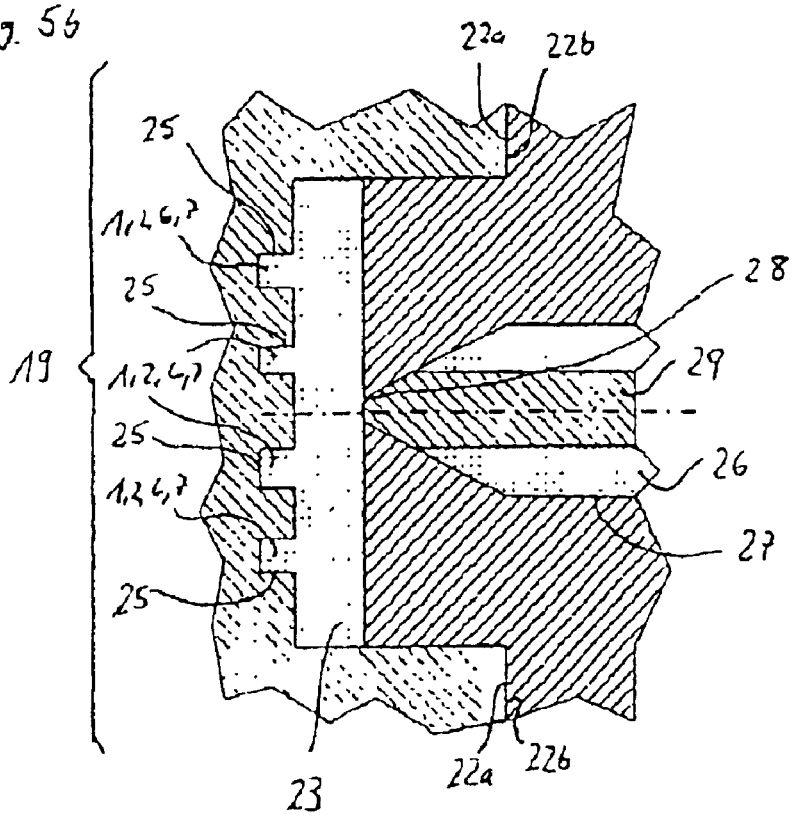
Figures 5C, 5D:
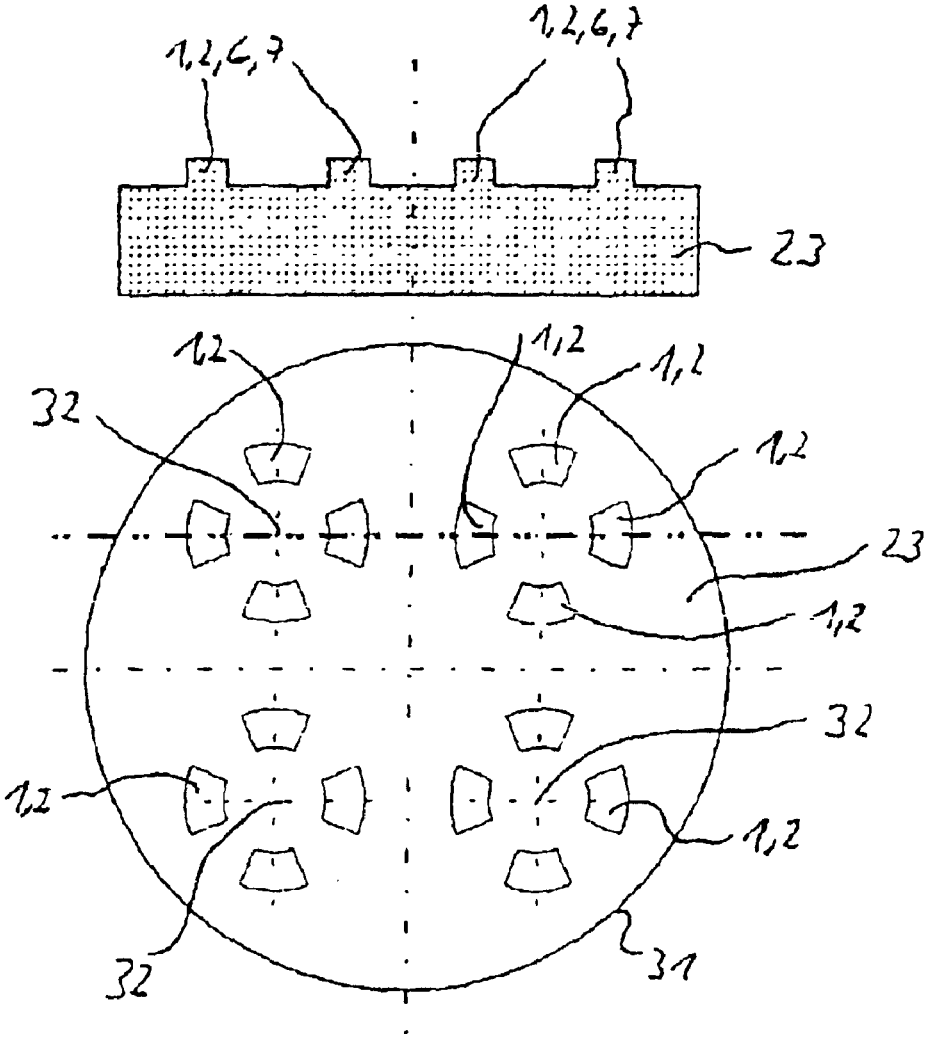

FIGS. 5*a* to 5*d* illustrate an injection compression process as a preferred method for the manufacture of the individual magnetic components 1, 2, 6, 7 as illustrated in FIGS. 1 to 4. FIG. 5*a* is a schematic illustration of the structure of an injection compression tool 19. The injection compression tool 19 has an upper tool half 20 and a lower tool half 21, each of which has a closing stop 22*a, b*. In the open position of the injection compression tool 19 shown in FIG. 5*a*, the two dosing stops 22*a, b* are separated from each other. To mold a plurality of individual magnetic components 1, 2, 6, 7 on a base plate 23, as illustrated in FIGS. 5*b* to 5*d*, the upper tool half 20 has a mold insert 24 that has a plurality of cavities 25. The bottom tool have 21 has for this purpose a gate channel 27 with a conically shaped injector tip 28 and an injection nozzle 29 for the injection or charging of a magnetizable material 26 into the mold insert 24, as illustrated in FIGS. 5*a, b*. The injection nozzle 29 is oriented centrally with respect to the injection tip 28 and to the mold insert 24. As shown in FIG. 5*a*, the magnetizable material 26 is first placed in the mold insert 24 in the form of a bubble 30.

In the closed position of the tool 19 illustrated in FIG. 5*b*, the bottom tool half 21 fits into the top tool half 20 until the two closing stops 22*a, b* come into contact with each other. On one hand, this causes the magnetizable material 26 to be pressed into the cavities 25. On the other hand, the injection nozzle 29 penetrates into the injector tip 28 and seals it off. This makes possible a small-volume casting and a defined separation of the magnetizable material 26 from the base plate 23 molded in the mold insert 24.

One very special teaching of the invention is that the arrangement specified for the manufacture by molding of the individual magnetic components 1, 2, 6, 7 using the mold insert 24 is transferred to the arrangement of the individual magnetic components 1, 2, 6, 7 on the base plate 23. Consequently, this arrangement and thus the fixed position of the various individual magnetic components 1, 2, 6, 7 with respect to one another is retained for the entire rest of the processing and handling of the individual magnetic components 1, 2, 6, 7, namely for the manufacture by molding of a magazine 40 with individual magnetic components 1, 2, 6,7, the magnetization and assembly of which into a magnet system 3 are retained, for example when they are assembled into a magnet ring 4 or a magnet strip 8. In this regard, FIG. 5*c* shows a sectional view and FIG. 5*d* a plan view from overhead of the base plate 23 unmolded from the injection compression tool 19 with a plurality of individual magnetic components 1, 2 in the form of segments of a circular ring located on it. As illustrated in FIG. 5*d*, the base plate 25 is realized in the external format of a wafer 31 with a dimension of 3, 4, 5 or 6 inches, for example. This teaching makes it possible to use the handling and transport technology of the semiconductor industry.

A further special teaching of the invention is that the individual magnetic components 1, 2, 6, 7 on the base plate 23, oriented as shown in FIG. 5*d*, are already arranged in groups 32, so that after they have been magazined and magnetized in this group arrangement, they can be assembled directly into a magnet system 3.

Figure 6A:
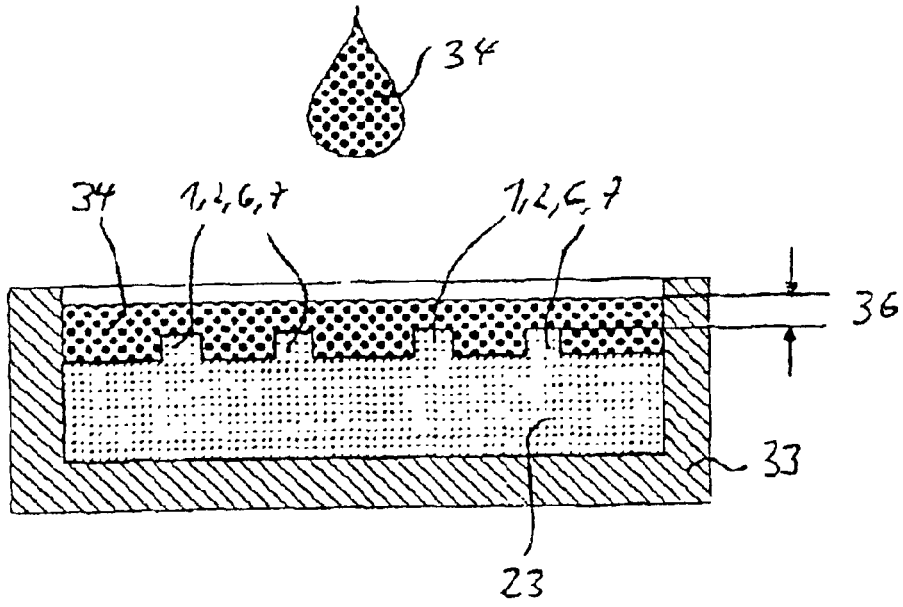
FIGS. 6*a–b* illustrate the manufacture by molding of a magazine that consists of a support and individual magnetic components.
Figure 6B:
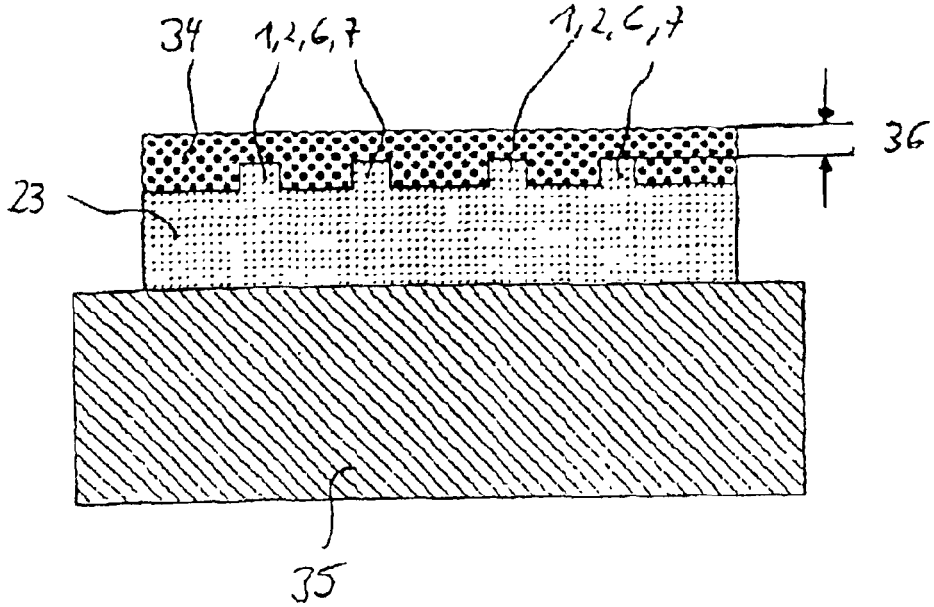

FIGS. 6*a* and 6*b* show the manufacturing by molding of a magazine 40 that consists of a carrier 10 and individual magnetic components 1, 2, 6, 7. FIG. 6*a* shows a two-component injection molding method as a preferred method for the manufacture by molding of the magazine 40 with individual magnetic components 1, 2, 6, 7 as illustrated in FIGS. 1 to 4. As illustrated in FIG. 6*a*, first the base plate 23 with the individual magnetic components 1, 2 located on it is set with an excess border on the side in a molding tray 33. Then the individual magnetic components 1, 2 are inserted from above with the two-component molding resin 34 that forms the carrier 10 and hardens. As a result of this process, the arrangement defined by the mold insert and transferred to the base plate 23 and the fixed position of the individual magnetic components 1, 2, 6, 7 with respect to one another is retained in the magazine 40. After the resin 34 has set, the base plate 23 with the individual magnetic components 1, 2, molded onto it are removed from the molding tray 33 and, as shown in FIG. 6*b*, are placed on a vacuum holding plate, to remove the flashing 36 of the resin 34 that extends beyond the individual magnetic components 1, 2 and the base plate 23 by milling.

Alternatively, the individual magnetic components 1, 2, 6, 7 and the magazine 40 can also be manufactured using a two-component injection molding process. For that purpose, the injection mold used is preferably of the type illustrated in FIGS. 2 to 4 of Patent Application DE 199 26 181. In general, it thereby becomes possible for the sequence of manufacturing operations of the magazine 40 and of the individual magnetic components 1, 2, 6, 7 to be selected as desired, depending on the configuration of the individual magnetic components and of the magazine. Thus the magazine 40 can be manufactured first and then the individual magnetic components 1, 2, 6, 7, for example in two immediately successive molding processes. Consequently, both the base plate 23 used during the two-component molding process and the mechanical post-treatment illustrated in FIG. 6*b* are no longer necessary for the manufacture of the magazine 40.

Figure 7A:
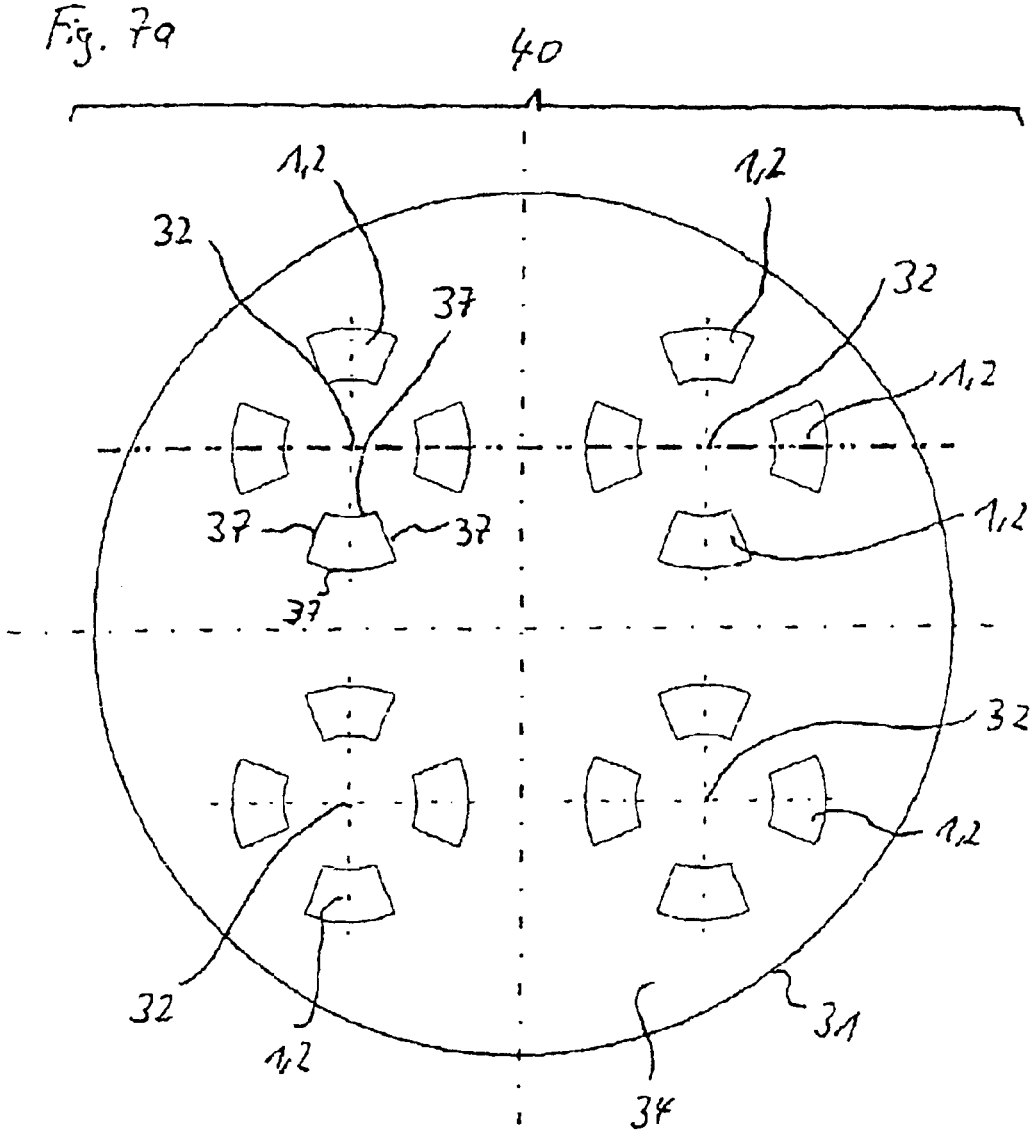
FIG. 7 a) is a plan view from overhead and b) is a section through a magazine as illustrated in FIG. 6 consisting of a support and individual magnetic components.
Figure 7B:
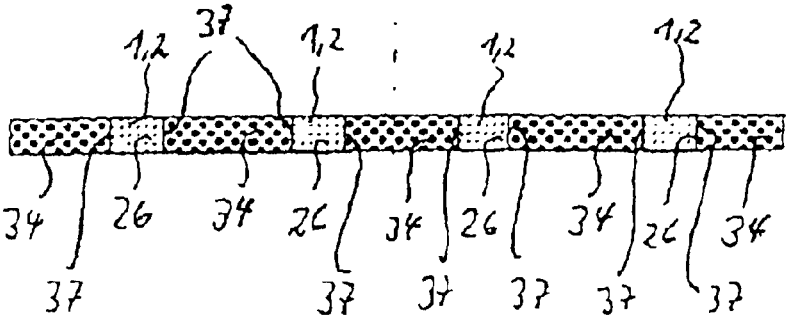

FIG. 7*a* is a plan view from overhead and FIG. 7*b* is a section through the magazine 40 manufactured in the manner described above with a plurality of individual magnetic components 1, 2. The individual magnetic components 1, 2 in the embodiment of the magazine 40 illustrated here are encompassed in a form-fitting manner by the molding material 34 on all their lateral surfaces, i.e. there is also molding material 34 between two neighboring individual magnetic components 1.2. As a result of this embodiment, it is possible to realize a flat magazine 40 that has the same height as the individual magnetic components 1, 2 with a plurality of individual magnetic components 1, 2, 6, 7 made of plastic-bonded NdFeB material. The comparison with FIG. 5*c* also shows that the arrangement of the individual magnetic components 1, 2 in groups 32 is also retained In the magazine 40. The advantage is that the individual magnetic components 1, 2 now need only be surrounded by the molding material 34 on their lateral surfaces 37 and do not, as in FIG. 5*c*, sit on the base plate 23, and further that the individual magnetic components 1, 2 can therefore be removed from the magazine 40 for assembly simply by pushing them out of the magazine 40.

Figure 8B:
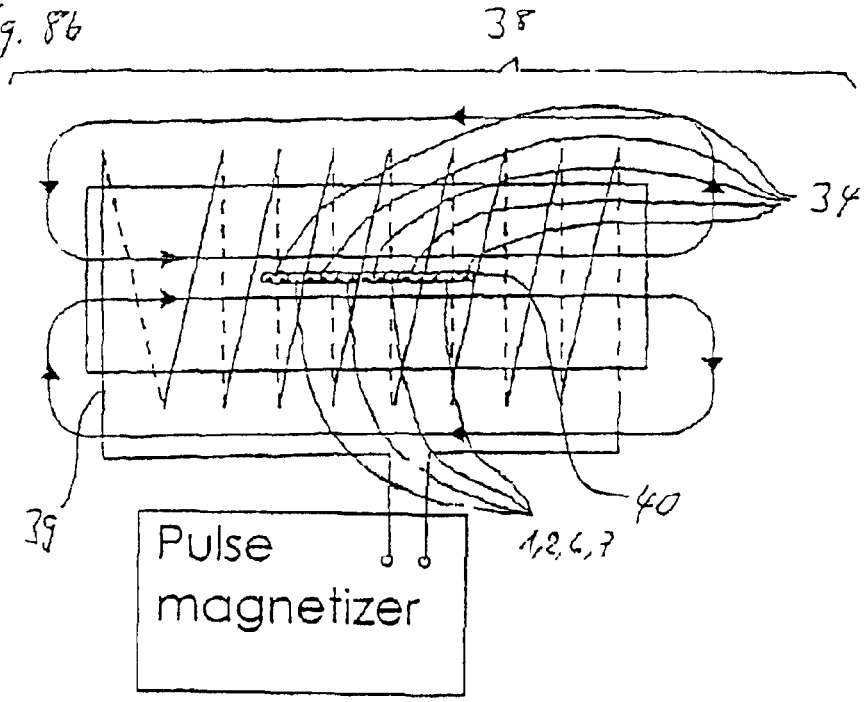

FIG. 8 shows a conventional magnetization device 38 with large magnetization coils 39 of the type used for the magnetization of all the individual magnetic components 1, 2, 6, 7 put together in the magazine 40 as shown in FIG. 7. The special advantage of this magnetization as taught by the invention is that all the individual magnetic components 1, 2, 6, 7 in the magazine 40 can be magnetized with a specified polarization together and simultaneously with one coil, and specifically regardless of the shape of the individual magnetic components 1, 2, 6, 7. Furthermore, with an appropriate sizing of the magnetization coils 39, only the individual magnetic components 1, 2, 6, 7 located in an area of the magazine 40, such as in one half of the magazine 40, can be magnetized in the same direction. It thereby becomes possible that in an overhead view of a magazine 40, one half of the magazine 40 has north magnetic poles and the other half of the magazine 40 has south magnetic poles. FIG. 8 shows an axial magnetization of all the individual magnetic components 1, 2, 6, 7 in the magazine 40, so that the individual magnetic components are magnetized with opposite polarity on the two end surfaces. FIG. 8*b* shows a diametrical magnetization of all the individual magnetic components 1, 2, 6, 7 in the magazine 40, so that the individual magnetic components 1, 2, 6, 7 can be magnetized with opposite polarity on their facing lateral surfaces. The particular advantage of this magnetization taught by the invention of the individual magnetic components 1, 2, 6, 7, which correspond to the magnet segments in the magnet system 3 to be formed, is that, compared to a magnetization of a complete magnet system 3, such as for example the magnet ring 4 in FIG. 1, the individual magnetic components 1, 2, 6, 7 can be completely magnetized all the way through. This prevents, among other things, a decay of the magnetic field in the peripheral areas of the individual magnetic components 1, 2, 6, 7. Consequently, the magnetic field decay in the neighboring magnet segments in the magnet system 3 is determined only by the combination of the oppositely magnetized individual magnetic components 1 and 2 or 6 and 7. In addition, a further miniaturization of the magnet systems 3, 4, 8, 12 to be formed with the individual magnetic components 1, 2, 6, 7 becomes possible, because even extremely small individual magnetic components 1, 2, 6, 7, manufactured by molding can be completely magnetized.

FIGS. 9 to 13 show various embodiments of the magazine 40 with the individual magnetic components 40 assembled inside them, which correspond to the magnetic segments in the magnet system 3 to be formed.

FIG. 9*a* Is a plan view from overhead and FIG. 9*b* is a detail, and FIG. 9*c* is a section through said detail of a magazine 40 with a plurality of circular ring-shaped individual magnetic components 1 to be magnetized axially, when viewed from overhead, in the north-south pole direction. FIG. 10 repeats the illustration in FIG. 9, although FIG. 10 shows a magazine 40 with a plurality of circular ring-shaped individual magnetic components 2 to be magnetized axially, when viewed from overhead, in the south-north pole direction. A comparison of the orientations of the individual magnetic components 1 in FIG. 9 with the individual magnetic components 2 in FIG. 10, in particular in the enlarged details shown in FIG. 10*b* and FIG. 9*b*, shows that the individual magnetic components 1, 2 are each arranged in groups 32 so that they are complementary to each other and are arranged in a circular ring, so that they can then be assembled directly into a multipole magnet ring 4 as illustrated in FIG. 1. FIGS. 9*c* and 10*c* show the axial magnetization of the individual magnetic components 1, 2 located in the group 32.

FIG. 11*a* shows a plan view from overhead and FIG. 11*b* shows a section through a magazine 40 with individual magnetic components 7 in the shape of a rectangular solid that are magnetized axially in the south-north pole direction. In this exemplary embodiment, the individual magnetic components 7 are located at some distance from one another in the magazine 40, so that between two neighboring individual magnetic components 7, there is the carrier 10 or molding material 34. Moreover, 10 individual magnetic components 7 are arranged parallel to one another in a magnet strip 8*a* as illustrated in FIG. 4*b*. The magazine 40 has, around each magnet strip 8*a*, a rectangular frame 18' made of magnetizable material 26 located around the individual magnetic components. This arrangement of the frame 18' makes it possible for the magnet strip 8*a* to be removed from the magazine 40 as a unit, i.e. with all 10 individual magnetic components 7. After the removal of the magnet strip 8*a* from the magazine 40, the frame 18' which is conventionally made of magnetizable material 26 is detached from the magnet strip 8*a*, so that then the individual magnetic components 7 can be assembled by a frame 18 made of molding material 34. The magnet strip 8*a* can be used, among other things, to manufacture magnet systems 3 with a greater distance between pole centers or even multilayer magnetic film systems 3, such as the magnetic scale 12 illustrated in FIG. 4 by way of example. As shown in FIG. 11*b*, the molding material 34 encompasses the individual magnetic components 7 in the exemplary embodiment illustrated here on their lateral surfaces in a form-fitting manner, so that the carrier 10 and the individual magnetic components 7 are realized with the same vertical dimension. An additional embodiment, not shown in the illustration, of the magazine 40 with individual magnetic components 1, 2, 6, 7 has the molding material 34 encompassing the individual magnetic components 1, 2, 6, 7 at least on parts of their outside surfaces, such as, for example, on at least parts of their end surfaces, so that it can act as a carrier 10. The individual magnetic components 1, 2, 6, 7 are therefore covered with molding material 34 to protect at least parts of their end surfaces. This embodiment can be used preferably if instead of the individual magnetic components 1, 2, 6, 7, entire magnet systems 3, such as for example the magnet strip 8*a*, are removed from the magazine 40 to manufacture a magnetic scale 12, for example. The molding material 34 on the end surface of an individual magnetic component 1, 2, 6, 7 can also be realized in the form of a connecting means for the location of an additional magnet strip, without thereby increasing the vertical dimension of the magnetic scale 12.

Figure 12:
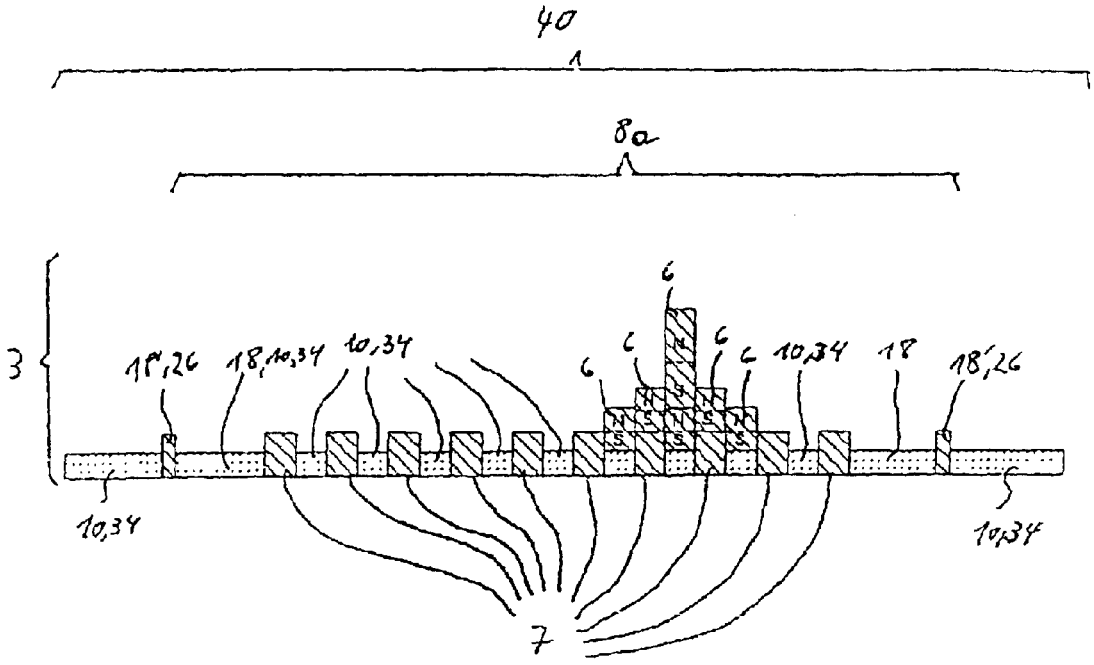
FIG. 12 is a section through an additional embodiment of the magazine with rectangular solid individual magnetic components magnetized in the south-north pole direction, whereby a magnet surface is manufactured.

FIG. 12 shows a section of a detail of an additional embodiment of the magazine 40 with individual magnetic components 7 in the form of a rectangular solid magnetized axially in the south-north pole direction. In this embodiment, in contrast to FIG. 11 b, the individual magnetic components 7 and the carrier 10 are manufactured with different heights. The purpose of this measure is to ensure that the carrier 10 is manufactured only with parts of the lateral surfaces 17*a*, *b* of the individual magnetic components 7 in adhesive contact. This reduced adhesive contact facilitates the process of releasing the magnet strip 8*a* from the magazine 40. Moreover, in this embodiment of the magazine 40, the removal of the individual magnetic components 7 from the magazine during the release process is also easier. For the manufacture of this embodiment of the magazine 40, preference is given to the use of a two-component injection molding process for the manufacture of the carrier 10 and of the individual magnetic components 7. In general, the structure of multipole magnet surfaces 3 forms a plurality of individual magnetic components 7 arranged in an offset pattern is possible, as illustrated schematically in FIG. 12. To construct this magnet surface, for example, an additional individual magnetic component 6 is inserted between two individual magnetic components 7 that are next to one another and project out of the carrier 10. This method is repeated until a sufficiently large checkerboard-pattern magnet surface consisting of north and south magnetic poles is manufactured.

Figure 13:
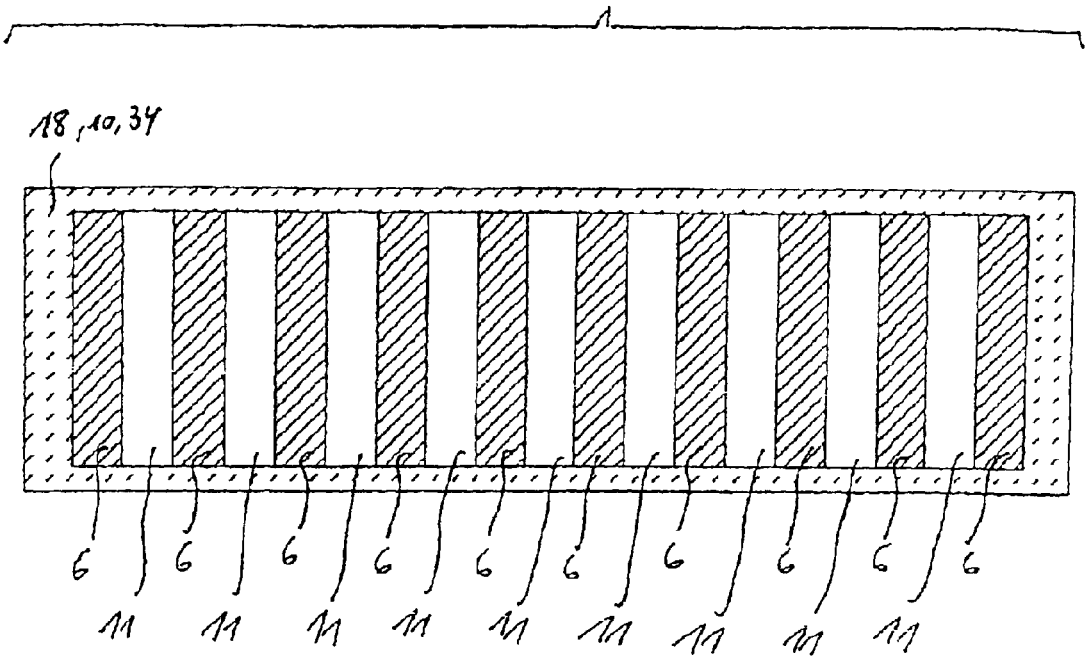
FIG. 13 is a plan view from overhead of a detail of an additional embodiment of a magazine with rectangular solid individual magnetic components and recesses magnetized axially in the north-south pole direction.

FIG. 13 shows a plan view from overhead of an additional embodiment of a magazine 40 with rectangular solid magnetic components 6 magnetized axially in the north south pole direction and recesses 11. Compared to the illustration in FIG. 11, this figure shows only a detail of the magazine 40 in the form of a magnet strip 8*c*. In this magnet strip 8*c*, only individual magnetic components 6 are arranged next to each other so that between two individual magnetic components 6 there is a recess 11. The individual magnetic components 6 are held together by the carrier 10 which is realized in the form of a strip-shaped frame 18.

Figure 14:
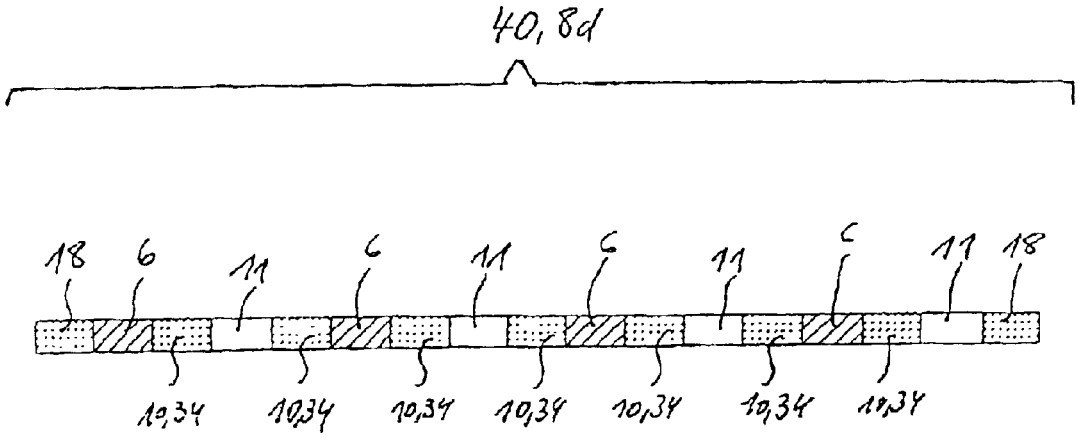
FIG. 14 is a section through a detail of an additional embodiment of a magazine with rectangular solid individual magnetic components and recesses magnetized axially in the north-south pole direction.

FIG. 14 shows a section through an additional embodiment of a magazine 40 with individual magnetic components 6 in the shape of a rectangular solid magnetized axially in the north-south pole direction and recesses 11, whereby only a portion of the magazine 40 is shown in the form of a magnet strip 8*d*. In contrast to the magnet strip 8*d* illustrated in FIG. 13, between each two individual magnetic components 6 in a row there is molding material 34, then a recess 11, and then molding material 34 again.

FIGS. 15 to 21 show various realizations of the assembly method claimed by the invention for the manufacture of a magnet system 3. The teaching common to all of these realizations is that to manufacture the magnet system 3, at least one magazine 40 is sued, and the individual magnetic components 1, 2, 6, 7 which correspond to the magnetic segments in the magnet system 3 to be formed, are positioned out of the magazine 40 directly into the assembly position on a carrier 10, so that a multipole magnet system 3, like the magnet ring 4, the magnet strip 8 or the magnetic scale 12, for example, is formed with alternating polarity on the two end surfaces.

Figure 15:
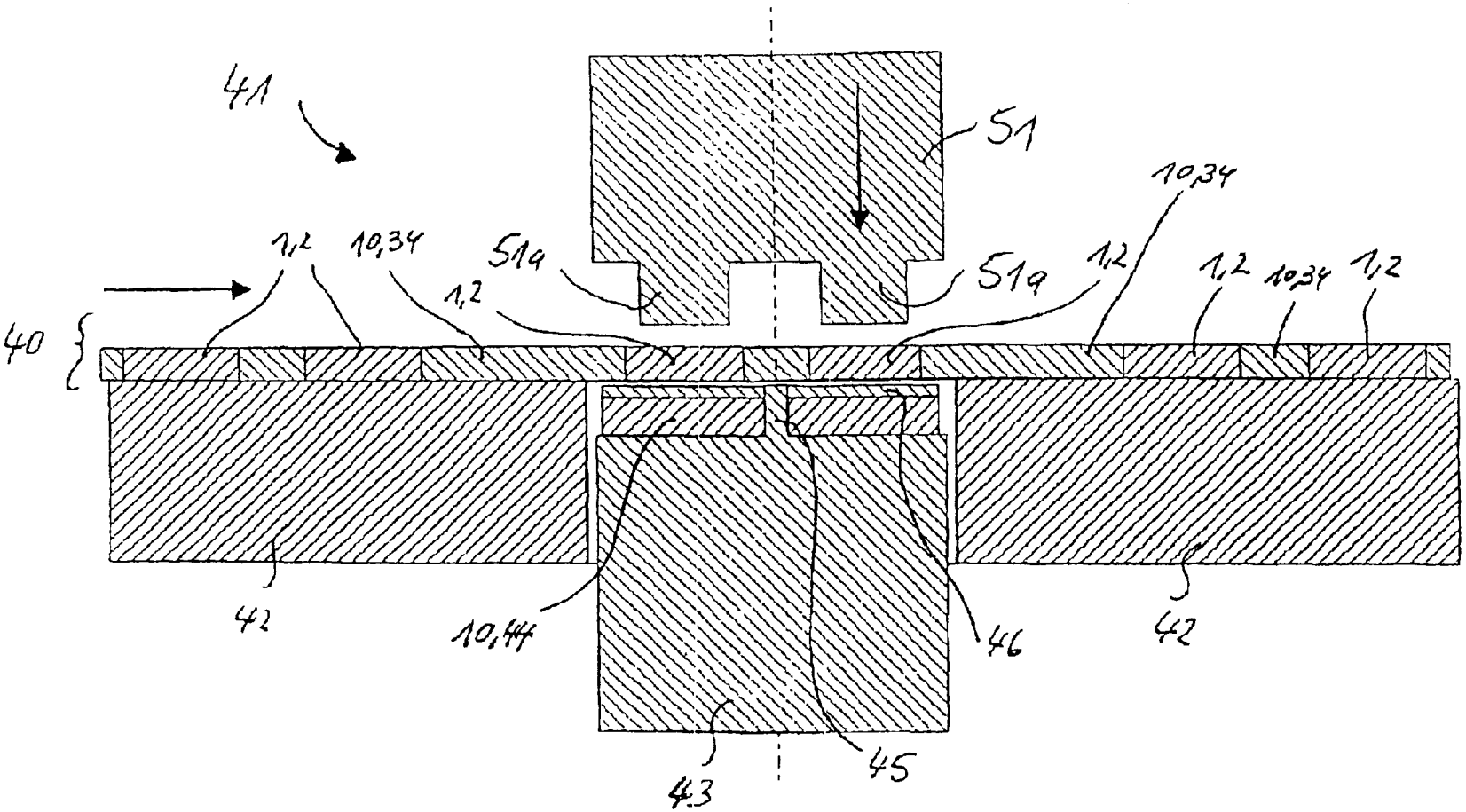
FIG. 15 shows assembly robots for the multiple assembly of multipole magnetic systems.

FIG. 15 shows an assembly robot 41 which is used for a particularly preferred multiple assembly of the individual magnetic components 1, 2, 6, 7 from the magazine 40 for the manufacture of the magnet system 3. For this purpose, the assembly robot 41, to press the individual magnetic components 1, 2, 6, 7 out of the magazine 40 into the assembly on the carrier 10, has an expulsion ram 51 with expulsion pins 51*a* and, as a support for the magazine 40, a support plate 42. In the support plate 42, directly underneath the expulsion ram 51, there is an anvil-like supporting ram 43. In the exemplary embodiment illustrated here, the rotor disc of the disc rotor motor described in the two patent applications DE 199 02 370 and DE 199 02 371 is being manufactured. For this purpose, in one preferred embodiment, first the individual magnetic components 1 magnetized in the north-south pole direction are transported to the magazine 40 as illustrated in FIG. 9 from the support plate 42, either by a feed table or by a conveyor belt. Then the carrier 10 in the form of the motor cover 44 of the disc rotor motor is located on the expulsion ram 42 directly opposite underneath the magazine 40 on a guide bolt 45 of the anvil-like supporting ram 43.

Then the expulsion ram 51 is lowered, pneumatically for example, in the direction indicated by the arrow in FIG. 15, and by means of the expulsion pins 51*a*, the entire group 32 of individual magnetic components 1 illustrated in the enlarged detail in FIG. 9*b* is pushed out onto the motor cover 44. To prevent a tipping of the individual magnetic components 1 after the individual magnetic components 1 have been detached from the magazine 40, the movement of the expulsion ram 51 can be synchronized with a movement in the opposite direction by the supporting ram 43 so that an expulsion of the individual magnetic components 1 becomes possible with the components being constantly guided both positively and non-positively. Consequently, on the motor cover 44 a magnet ring 3 is formed, in which there is a space between each two individual magnetic components 1. Then the expulsion ram 51 is raised again and a magazine 40 of the type illustrated in FIG. 10 with individual magnetic components 2 magnetized in the south-north pole direction Is guided to the support plate 42 and oriented so that the individual magnetic components 2 arranged in groups 32 complementary to the individual magnetic components 2 can be expelled directly into the remaining spaces of the magnet ring 3 on the motor cover 44. The motor cover 44 has an adhesive coating to fix the individual magnetic components 1, 2 in position. Finally the disc rotor, which consists of the motor cover 44 with the magnet ring 5 affixed to it, is removed from underneath the expulsion ram 51 and the next rotor disc is manufactured.

Figure 16:
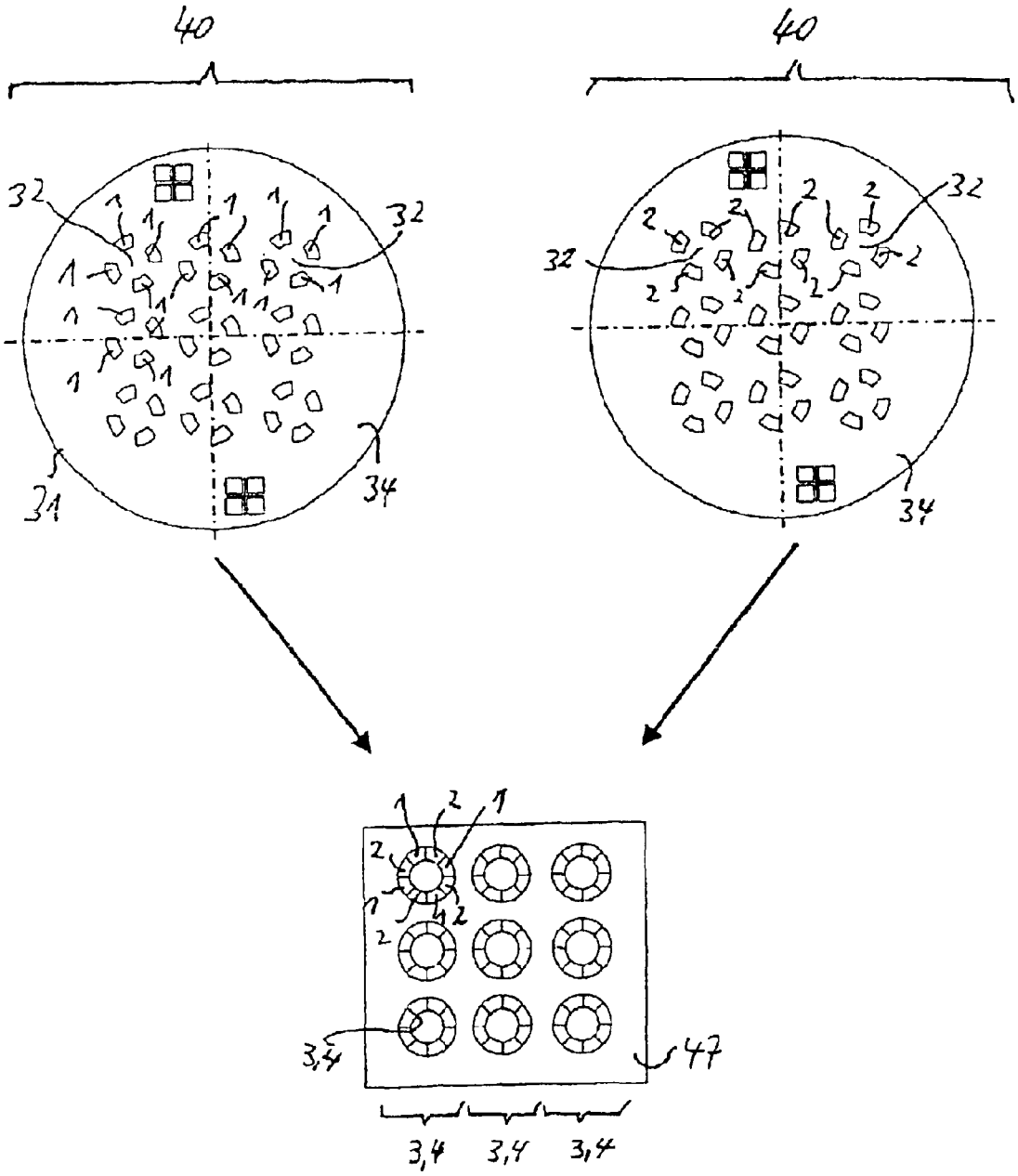
FIG. 16 shows the assembly of a plurality of magnetic rings as illustrated in FIG. 1 on an assembly plate with two magazines with individual magnetic components as illustrated in FIGS. 9 and 10.

FIG. 16 illustrates and repeats the assembly process described above from two magazines with individual magnetic components as illustrated in FIGS. 9 and 10 for the manufacture of a magnet ring 3 from FIG. 1. In this case, a preferably soft magnetic assembly plate 47 is used as the carrier 10 to fix the individual magnetic components 1, 2 in position. The adhesive layer 46 can thereby be eliminated.

Figure 17:
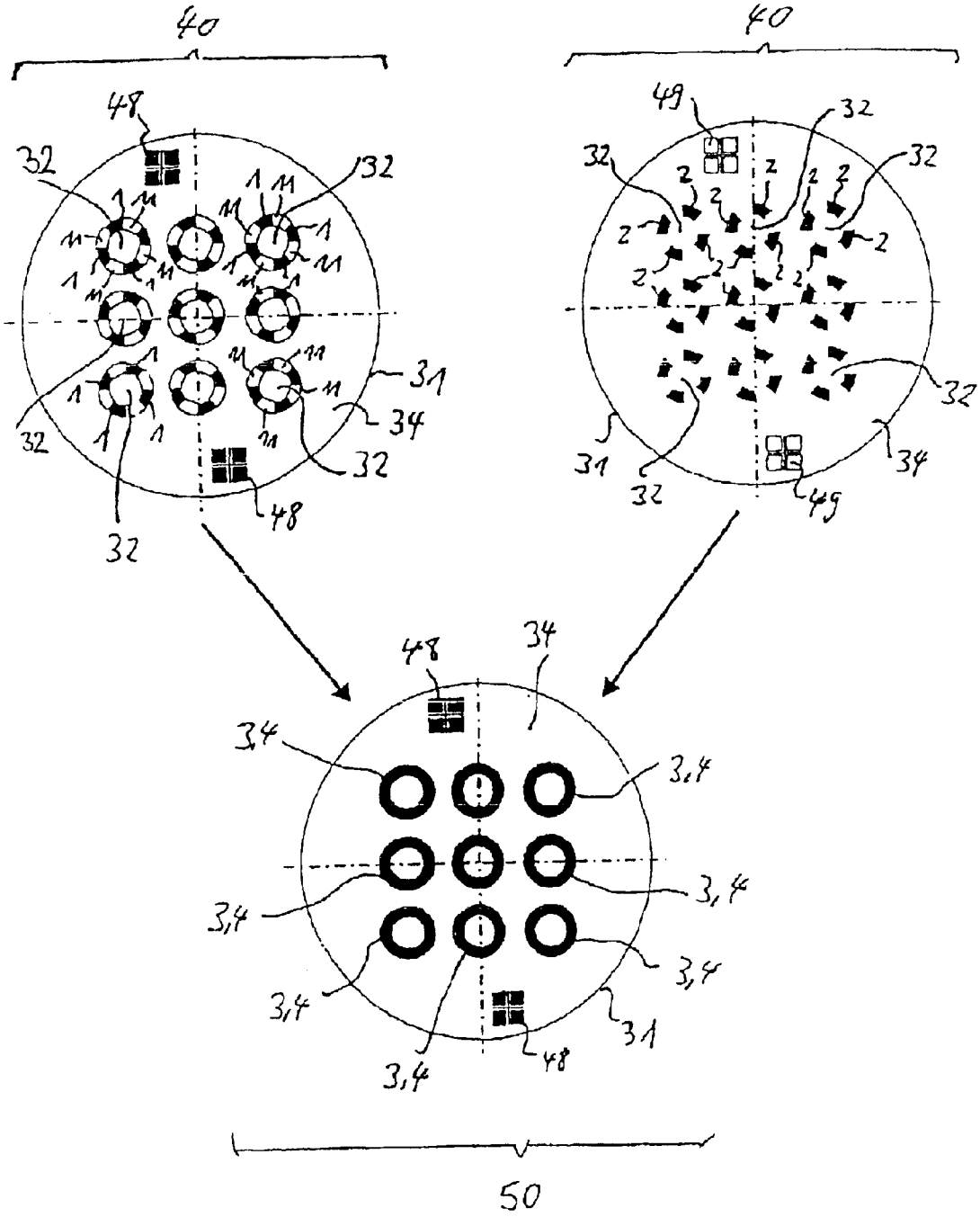
FIG. 17 shows the assembly of a magazine with a plurality of magnetic rings illustrated in FIG. 1 with a magazine with individual magnetic components and recesses and a magazine with individual magnetic components as illustrated in FIG. 10.
Figure 18:
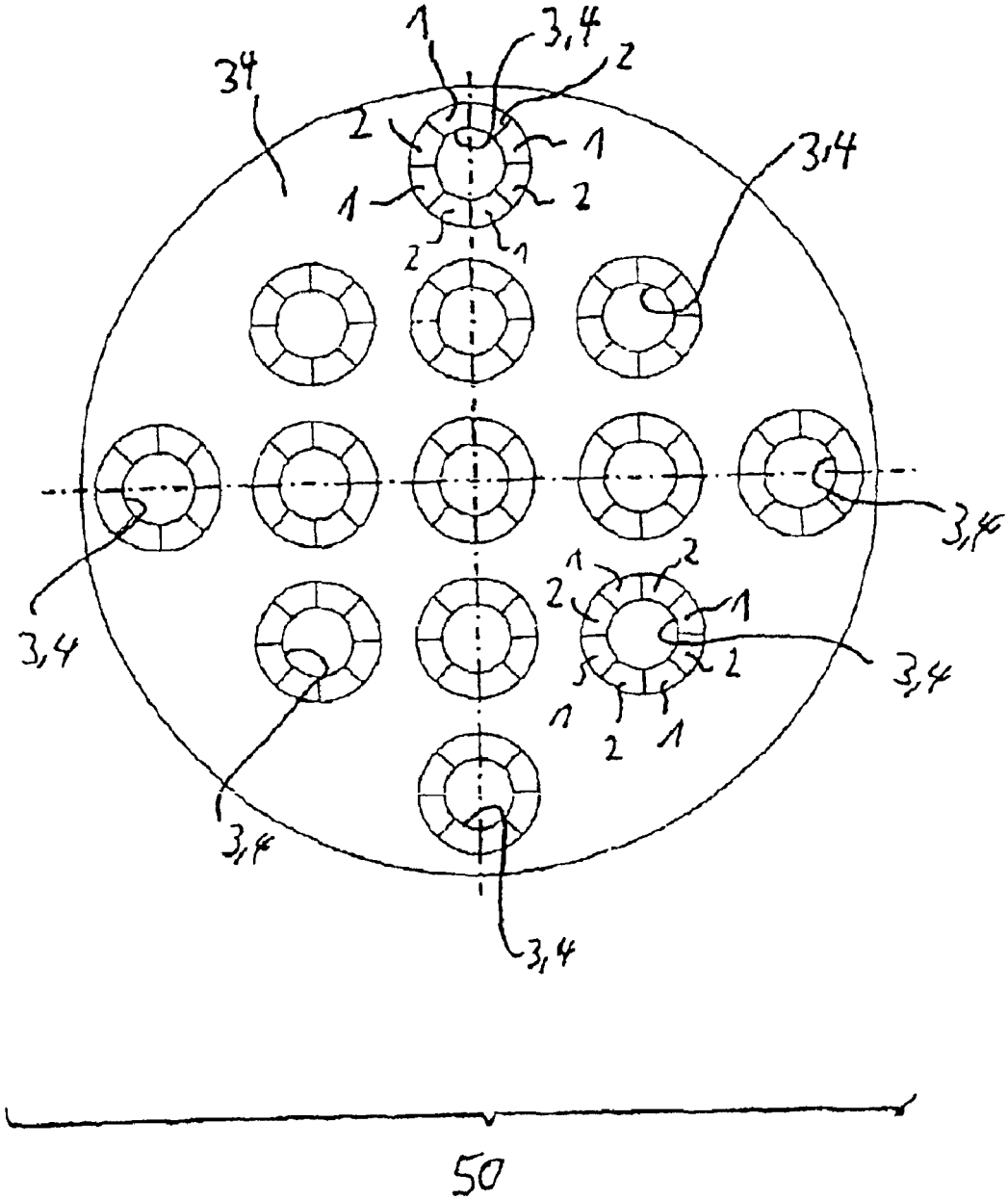
FIG. 18 shows a magazine with a plurality of magnet rings as illustrated in FIG. 1.

FIG. 17 shows another embodiment of the assembly method for the manufacture of magnet rings. In this case, a magazine 40 as shown in FIG. 9 is used with individual magnetic components 2 arranged in groups 32. The carrier 10 is a magazine 40 with individual magnetic components 1 arranged in groups, in which, as illustrated in FIG. 13, there is at least one recess 11 between each two neighboring individual magnetic components. For the manufacture of the magnet ring 3, the individual magnetic components 2 are pushed out by the expulsion pins 51*a* of the assembly robot 41 directly into the recesses 11. The result, as shown in FIG. 18, is a magazine 50 which is made of hardened molding material 34, preferably two-component resin 34*a* or plastic, which encompasses a plurality of magnet rings 3 consisting of individual magnetic components 1, 2 at least on parts of one lateral surface.

Figure 19A:
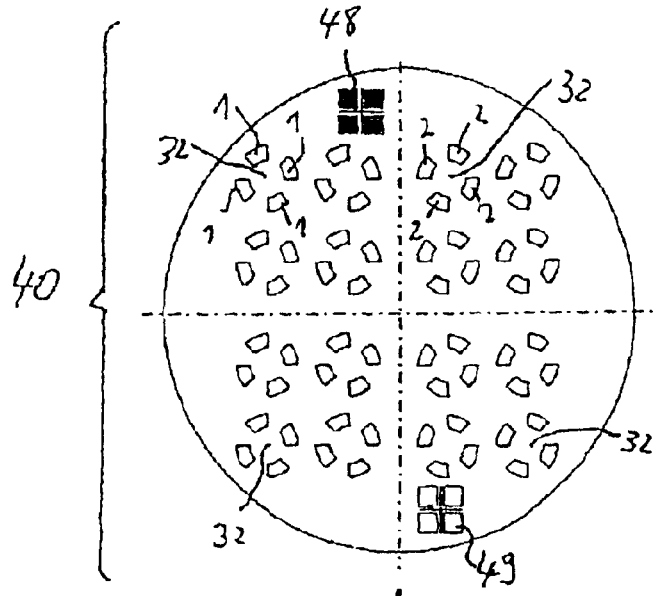
FIG. 19 illustrates the assembly of magnet rings as illustrated in FIG. 1 on an assembly plate with a magazine with individual magnetic components.
Figure 19B:
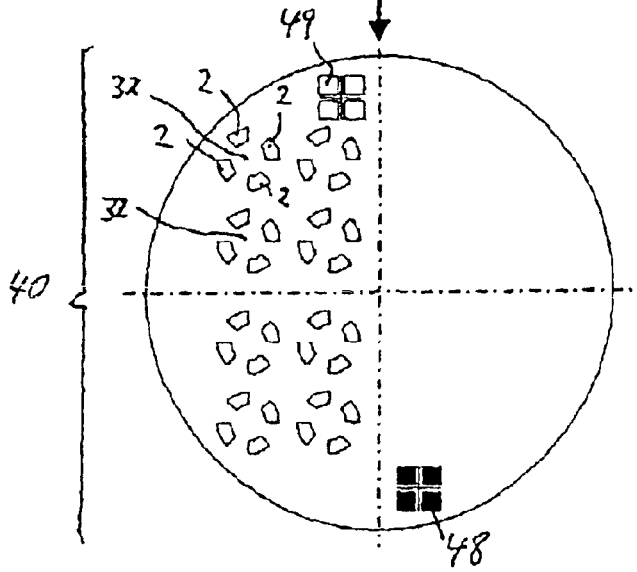
Figure 19C:
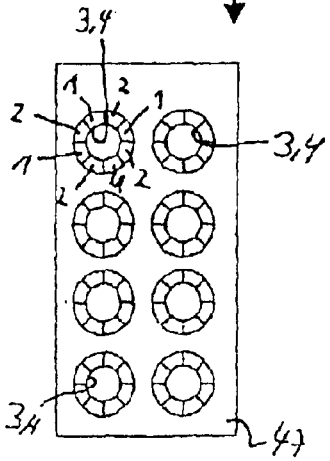

FIGS. 19*a* to *c* show the assembly of magnet rings 3 from FIG. 1 on a soft magnetic assembly plate 47, whereby only one magazine 40 is being used. As shown in FIG. 19*a*, this magazine 40, on the first half of the magazine 40 identified by the number 48, has only individual magnetic components 1 magnetized in the north-south pole direction, and on the second half identified by the number 49, only individual magnetic components 2 magnetized in the south-north pole direction. Using the assembly robot 41, first the individual magnetic components 1 located in a group 32 in the first half are expelled onto the assembly plate 47 and fixed in position. Then the magazine 40, as a comparison of FIGS. 18*a* and 18*b* shows, is rotated by 180°. Then the individual magnetic components 2 magnetized as shown in FIG. 18*b* in the south-north pole direction and arranged in a group 2 are expelled onto the assembly plate 47. As a result, a plurality of magnet rings, 3 are formed on the assembly plate 47, as shown in FIG. 19*c*.

Figure 20:
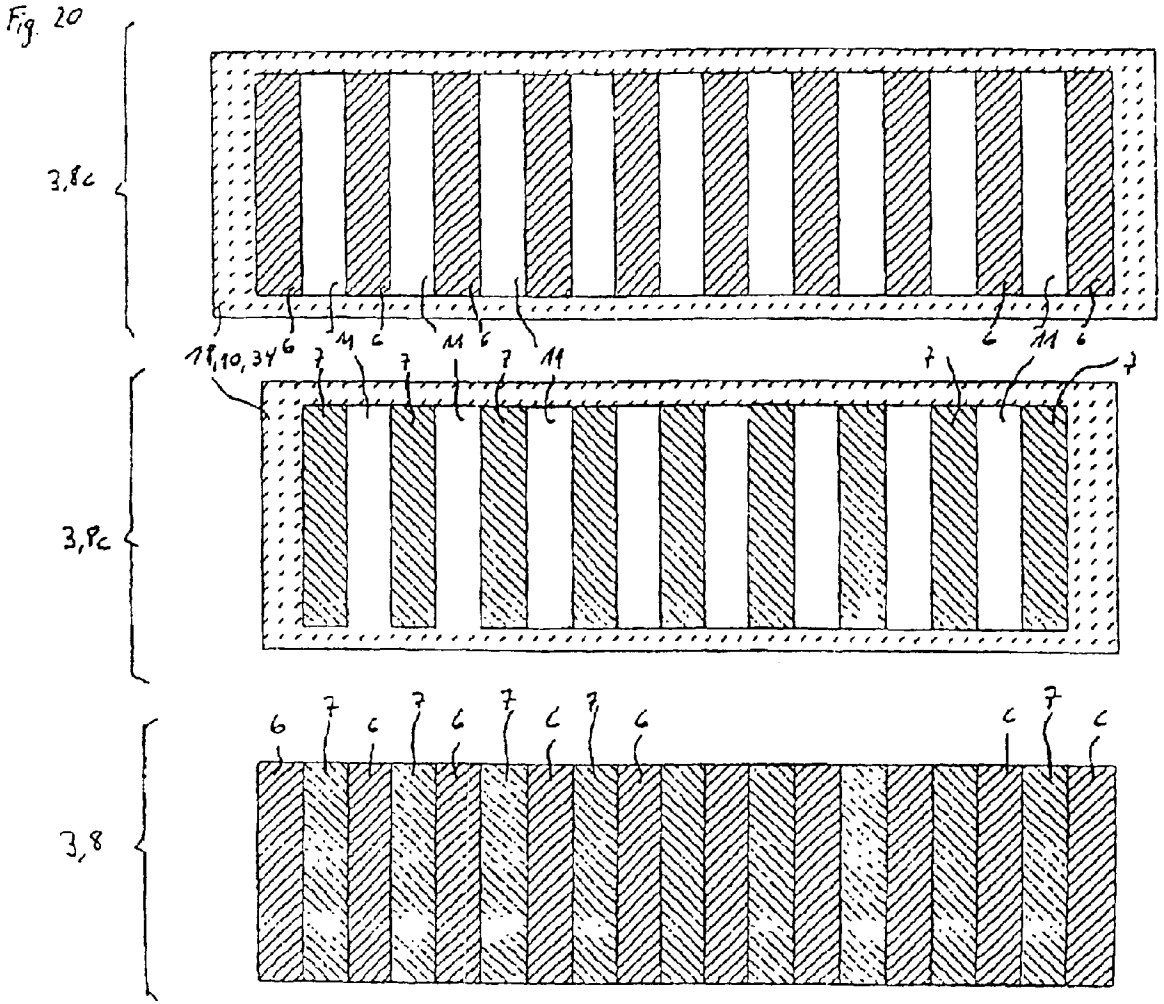
FIG. 20 illustrates the assembly of a magnet strip as illustrated in FIG. 2 on an assembly plate from two magazines as illustrated in FIG. 13.

FIG. 20 shows the manufacture of a magnet strip 8 of the type illustrated in FIG. 2. For this purpose, two magazines 40 as illustrated in FIG. 13 with, on one hand, individual magnetic components 6 arranged in a magnet strip 8*c* and magnetized in the north-south pole direction, and on the other hand individual magnetic components 7 arranged in a magnet strip 8*c* and magnetized in the south-north pole direction are fed to the assembly robot 41 one after the other. First, by means of the expulsion pins 51*a*, all the individual magnetic components 6 are pushed out of the corresponding magnet strip 8*c* onto the carrier, which is not shown here, and are fixed in position with an adhesive if necessary. The result is that first a magnet strip 8 is formed, in which a space is located between two neighboring individual magnetic components 6. Then the individual magnetic components 7 are pushed out of the corresponding magnet strip 8*c* as illustrated in FIG. 13 onto the carrier (backing) and into these spaces. The result is the magnet strip 8 with individual magnetic components 6, 7 lying directly next to each other, as shown in FIG. 20.

FIG. 21 shows that with a magnet strip 8*c* as illustrated in FIG. 21*b*, each of which has a recess 11 between two neighboring individual magnetic components 7 and a frame 18 in the form of the carrier 10, it is possible to manufacture a multipole magnet strip 8 as illustrated in FIG. 21*c* with individual magnetic components 6, 7 directly next to one another and an outer frame 18. For this purpose, the magnet strip 8*c* in the exemplary embodiment selected here and illustrated in FIG. 21*b* has a base plate 53. Individual magnetic components 6 arranged in a magnet strip 8*b* as shown in FIG. 21*a* are then placed on this base plate 53 and inserted in the recesses 11. Then the base plate 53 is removed, by milling, for example, to form the multipole magnet strip 8 illustrated in FIG. 21*c* with individual magnetic components 6, 7 lying directly next to each other and the outer frame 18.

Figure 22:
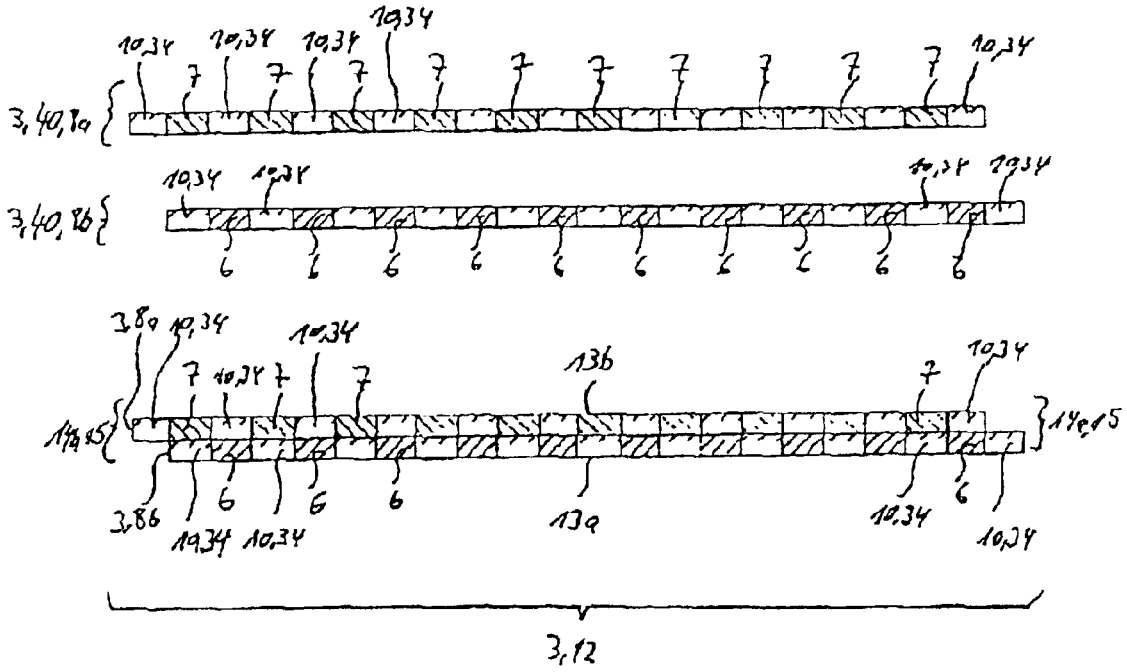
FIG. 22 illustrates the assembly of a magnetic scale as illustrated in FIG. 4 with two magazines as illustrated in FIG. 11.

Finally, FIG. 22 illustrates the assembly of a magnetic scale 12 as shown in FIG. 4. For this purpose, two magazines 40 as shown in FIG. 11 with the magnet strips 8*a, b* in them, with on one hand individual magnetic components 6 that are separated from one another by molding material 34 and are magnetized axially in the north-south pole direction, and on the other hand individual magnetic components 7 arranged in a corresponding manner and magnetized axially in the south-north pole direction are used. The two magnet strips 8*a, b* shown in FIG. 22 are located on one another as illustrated in FIG. 22 so that the individual magnetic components 7 are laterally offset from the individual magnetic components 6, forming a magnetic scale 12 with alternating polarity on the two end surfaces 13*a, b*.

The magnet strip 8 illustrated in FIG. 3 is manufactured by using a magazine 40 as illustrated in FIG. 14 with individual magnetic components 6, in which, between each two neighboring individual magnetic components 6 there is molding material 34, then a recess 11, and then more molding material 34. Then individual magnetic components 7 are pressed into these recesses 11. For this purpose, for example, a magazine 40 as illustrated in FIG. 11 with individual magnetic components 7 is used, in which the distance between two neighboring individual magnetic components 7 is adapted to the distance between the recesses 11. The advantage of the manufacture as taught by the invention of a magnet system 3 from a plurality of individual magnetic components 1, 2, 6, 7 which are arranged in a magazine 40 with a fixed position in relation to one another, is that extremely flat multipole magnet systems 3 can be manufactured as illustrated in FIGS. 1 to 4. For example, this method can be used to manufacture extremely flat multipole magnet rings 4 as illustrated in FIG. 1 or magnet strips 8 as illustrated in FIG. 2 with individual magnetic components 1, 2 and 6, 7 respectively directly next to each other. The particular advantage of these magnet systems 3 is that no supporting or retaining structures need to be located between the individual magnetic components 1, 2, 6, 7 that form the magnet segments. As a result, a particularly high density of integration of individual magnetic components 1, 2, 6, 7 becomes possible in the magnet system 3 with almost any desired small distance between pole centers, whereby the invention teaches that only the assembly tolerance of the individual magnetic components 1, 2, 6, 7 is a limiting factor in the manufacture of the magnet system 3. The invention teaches that this assembly tolerance is already reduced to a very low amount, because on one hand the individual magnetic components 1, 2, 6, 7 are held in a defined position of the individual magnetic components 1, 2,6,7 with respect to one another by the mold insert used in the molding portion of the manufacturing operation. On the other hand, the invention teaches that the individual magnetic components 1, 2, 6, 7 are arranged in groups with respect to one another so that they can be removed together in this group arrangement directly from the magazine 40 and assembled into the magnet system 3. Thus the assembly tolerance is determined only by the precision of the transfer or the assembly of the individual magnetic components 1, 2, 6, 7 out of the magazine 40 and into the magnet system 3. An additional general advantage of the invention is that the individual magnetic components 1, 2, 6, 7 assembled in a plurality in a magazine 40 can be completely and simultaneously magnetized all the way through in a conventional magnetization device. As a result, in particular even losses that are caused during the multipole magnetization of a complete multipole magnet system, for example a multipole magnet ring, can be prevented by superimposing the coil windings of the magnetization device with the magnet segments.

The invention teaches that, with the individual magnetic components 1, 2, 6, 7 claimed by the invention or the magazines 40 claimed by the invention with individual magnetic components 1, 2, 6, 7, even extremely flat multipole magnet systems 3 as illustrated in FIG. 3 can be manufactured, in which between two neighboring individual magnetic components 6, 7 there is a carrier 10 made of molding material 34. This carrier here is used only as a lateral support or retaining structure, whereby the height of the magnet system 3 is not thereby increased. As a result of this arrangement of the carrier 0, a greater distance between pole centers of the individual magnetic components 1, 2, 6, 7 is also achieved, which can be a very desirable feature in certain magnet systems 3.

Moreover, the invention teaches that additional flat multipole magnet systems 3 can be manufactured, like the checkerboard-pattern magnetic surface 3 illustrated by way of example in FIG. 12. Flat magnet systems 3 as claimed by the invention can also be used to construct three-dimensional magnet bodies 3, such as the magnetic scale 12 illustrated in FIG. 4, for example. The invention also teaches that the individual magnetic components 1, 2, 6, 7 can be released from the corresponding magazine 40 and then stacked to form a three-dimensional magnetic body 3.

Nomenclature:

1 Individual magnetic component
2 Individual magnetic component
3 Magnet system
4 Magnet ring
5*a, b* End surface
6 Individual magnetic component
7 Individual magnetic component
8 Magnet strip
8*a, b, c, d* Magnet strip
9*a, b* End surface
10 Carrier
11 Recess
12 Magnetic scale
13*a, b* End surface
14*a, b* Transverse side end
15 Step
16*a, b* Lateral surface
17*a, b* Lateral surface
18, 18' Frame
19 Injection compression tool
20 Top tool half
21 Bottom tool half
22*a, b* Closing stop
23 Base plate
24 Mold insert
25 Cavity
26 Magnetizable material
27 Injection channel
28 Injection Up
29 Injection nozzle
30 Bubble
31 Wafer
32 Group with individual magnetic components

33 Casting pan
34 Molding material
34*a* Two-component resin
35 Vacuum retaining plate
36 Flashing
37 Lateral surface
38 Magnetizing device
39 Coil
40 Magazine
41 Assembly robot
42 Support plate
43 Supporting ram
44 Motor cover
45 Guide pins
46 Adhesive layer
47 Assembly plate
48 Reference marking
49 Additional reference marking
50 Magazine
51 Expulsion ram
51*a* Expulsion pins
52 External shape
53 Base surface

What is claimed is:

1. A magazine for a plurality of magnetic components, comprising:

the magazine, wherein the magazine is made of a hardening molding material which encompasses the individual magnetic components made of magnetizable material only on portions of their outer surfaces, whereby the individual magnetic components are located in the magazine at some distance from one another and are all magnetized in the same direction.

2. A magazine according to claim 1, wherein the individual magnetic components are magnetized along their longitudinal or transverse dimension.

3. A magazine according to claim 2, wherein the individual magnetic components are made of a plastic-bonded rare-earth magnetic material.

4. A magazine according to claim 3, wherein the individual magentic components are made of a rare-earth magnetic material containing NdFeB or SmCo.

5. A magazine according to claim 3, wherein the magazine has a disc-shaped or strip-shaped outer contour.

6. A magazine according to claim 5, wherein the individual magnetic components have the external shape of a circular ring segment or a rectangular solid.

7. A magazine according to claim 6, wherein molding material is located between two neighboring individual magnetic components.

8. A magazine according to claim 6, wherein there is at least one recess between two neighboring individual magnetic components.

9. A magazine according to claim 6, wherein molding material and at least one recess are located between two neighboring individual magnetic components.

10. A magazine according to claim 1, wherein the individual magnetic components are made of a plastic-bonded rare-earth magnetic material.

11. A magazine according to claim 1, wherein the magazine has a disc-shaped or strip-shaped outer contour.

12. A magazine according to claim 1, wherein the individual magnetic components have the external shape of a circular ring segment or a rectangular solid.

13. A magazine according to claim 1, wherein molding material is located between two neighboring individual magnetic components.

14. A magazine according to claim 1, wherein there is at least one recess between two neighboring individual magnetic components.

15. A magazine according to claim 1, wherein molding material and at least one recess are located between two neighboring individual magnetic components.

16. A magazine according to claim 1, wherein the individual magnetic components are made of a rare-earth magnetic material containing NdFeB or SmCo.

* * * * *